US007360594B2

(12) United States Patent
Giroux et al.

(10) Patent No.: US 7,360,594 B2
(45) Date of Patent: Apr. 22, 2008

(54) DRILLING WITH CASING LATCH

(75) Inventors: Richard L. Giroux, Cypress, TX (US); Gary Thompson, Katy, TX (US); Albert C. Odell, III, Kingwood, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 274 days.

(21) Appl. No.: 10/795,214

(22) Filed: Mar. 5, 2004

(65) Prior Publication Data

US 2004/0216892 A1 Nov. 4, 2004

Related U.S. Application Data

(60) Provisional application No. 60/452,200, filed on Mar. 5, 2003.

(51) Int. Cl.
*E21B 17/00* (2006.01)

(52) U.S. Cl. ..... 166/242.6; 166/380

(58) Field of Classification Search ..... 166/380, 166/387, 120, 242.6; 175/260, 261, 258
See application file for complete search history.

(56) References Cited

U.S. PATENT DOCUMENTS

| | | | |
|---|---|---|---|
| 122,514 | A | 1/1872 | Bullock |
| 761,518 | A | 5/1904 | Lykken |
| 1,077,772 | A | 11/1913 | Weathersby |
| 1,185,582 | A | 5/1916 | Bignell |
| 1,301,285 | A | 4/1919 | Leonard |
| 1,324,303 | A | 12/1919 | Carmichael |
| 1,342,424 | A | 6/1920 | Cotten |

(Continued)

FOREIGN PATENT DOCUMENTS

| | | |
|---|---|---|
| EP | 0 162 000 | 11/1985 |

(Continued)

OTHER PUBLICATIONS

Detlef Hahn, Friedhelm Makohl, and Larry Watkins, Casing—While Drilling System Reduces Hole Collapse Risks, Offshore, pp. 54, 56, and 59, Feb. 1998.

(Continued)

*Primary Examiner*—Jennifer H. Gay
*Assistant Examiner*—Daniel P Stephenson
(74) *Attorney, Agent, or Firm*—Patterson & Sheridan, LLP

(57) ABSTRACT

A latch assembly, and methods of using the latch assembly, for use with a bottom hole assembly (BHA) and a tubular, are provided. In one embodiment, the latch assembly is disposable within the tubular, configured to be rotationally and axially coupled to the tubular. In one aspect of the embodiment, latch assembly is configured to be released from the tubular by applying a tensile force to the latch assembly. The latch the latch assembly may comprise: one or more sleds disposed within one or more respective slots formed along at least a portion of a locking mandrel; and one or more retractable axial drag blocks configured to engage a matching axial profile disposed in the tubular, wherein each axial drag block is coupled to the respective sled with one or more biasing members; and the locking mandrel actuatable between a first position and a second position and preventing retraction of the axial drag blocks when actuated to the second position. The latch assembly may also comprise a drag block body having a bore therethorugh; and one or more retractable torsional drag blocks configured to engage a matching torsional profile disposed in the tubular, wherein each torsional drag block is coupled to the drag block body with a biasing member.

29 Claims, 19 Drawing Sheets

U.S. PATENT DOCUMENTS

| | | | |
|---|---|---|---|
| 1,418,766 | A | 6/1922 | Wilson |
| 1,459,990 | A | 6/1923 | Reed |
| 1,471,526 | A | 10/1923 | Pickin |
| 1,545,039 | A | 7/1925 | Deavers |
| 1,561,418 | A | 11/1925 | Duda |
| 1,569,729 | A | 1/1926 | Duda |
| 1,585,069 | A | 5/1926 | Youle |
| 1,597,212 | A | 8/1926 | Spengler |
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |
| 1,851,289 | A | 3/1932 | Owen |
| 1,880,218 | A | 10/1932 | Simmons |
| 1,917,135 | A | 7/1933 | Littell |
| 1,930,825 | A | 10/1933 | Raymond |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,102,555 | A | 12/1937 | Dyer |
| 2,105,885 | A | 1/1938 | Hinderliter |
| 2,167,338 | A | 7/1939 | Murcell |
| 2,214,226 | A | 9/1940 | English |
| 2,214,429 | A | 9/1940 | Miller |
| 2,216,226 | A | 10/1940 | Bumpous |
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church et al. |
| 2,324,679 | A | 7/1943 | Cox |
| 2,344,120 | A | 3/1944 | Baker |
| 2,345,308 | A | 3/1944 | Wallace |
| 2,370,832 | A | 3/1945 | Baker |
| 2,379,800 | A | 7/1945 | Hare |
| 2,383,214 | A | 8/1945 | Prout |
| 2,414,719 | A | 1/1947 | Cloud |
| 2,499,630 | A | 3/1950 | Clark |
| 2,522,444 | A | 9/1950 | Grable |
| 2,536,458 | A | 1/1951 | Munsinger |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bieber et al. |
| 2,668,689 | A | 2/1954 | Cormany |
| 2,692,059 | A | 10/1954 | Bolling, Jr. |
| 2,696,367 | A | 12/1954 | Robishaw |
| 2,720,267 | A | 10/1955 | Brown |
| 2,738,011 | A | 3/1956 | Mabry |
| 2,741,907 | A | 4/1956 | Genender et al. |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,898,971 | A | 8/1959 | Hempel |
| 2,953,406 | A | 9/1960 | Young |
| 2,978,047 | A | 4/1961 | DeVaan |
| 3,001,585 | A | 9/1961 | Shiplet |
| 3,006,415 | A | 10/1961 | Burns et al. |
| 3,041,901 | A | 7/1962 | Knights |
| 3,054,100 | A | 9/1962 | Jones |
| 3,087,546 | A | 4/1963 | Woolley |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,193,116 | A | 7/1965 | Kenneday et al. |
| 3,195,646 | A | 7/1965 | Brown |
| 3,273,660 | A | 9/1966 | Jackson et al. |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,467,180 | A | 9/1969 | Pensotti |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,848 | A | 1/1971 | Van Wagner |
| 3,559,739 | A | 2/1971 | Hutchison |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Weiner |
| 3,621,910 | A | 11/1971 | Sanford |
| 3,624,760 | A | 11/1971 | Bodine |
| 3,635,105 | A | 1/1972 | Dickmann et al. |
| 3,656,564 | A * | 4/1972 | Brown ..... 175/228 |
| 3,662,842 | A | 5/1972 | Bromell |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,700,048 | A | 10/1972 | Desmoulins |
| 3,712,376 | A | 1/1973 | Owen et al. |
| 3,729,057 | A | 4/1973 | Werner |
| 3,746,330 | A | 7/1973 | Taciuk |
| 3,747,675 | A | 7/1973 | Brown |
| 3,760,894 | A | 9/1973 | Pitifer |
| 3,776,307 | A | 12/1973 | Young |
| 3,776,320 | A | 12/1973 | Brown |
| 3,776,991 | A | 12/1973 | Marcus |
| 3,785,193 | A | 1/1974 | Kinley et al. |
| 3,808,916 | A | 5/1974 | Porter et al. |
| 3,818,734 | A | 6/1974 | Bateman |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,870,114 | A | 3/1975 | Pulk et al. |
| 3,881,375 | A | 5/1975 | Kelly |
| 3,885,679 | A | 5/1975 | Swoboda, Jr. et al. |
| 3,901,331 | A | 8/1975 | Djurovic |
| 3,911,707 | A | 10/1975 | Minakov et al. |
| 3,913,687 | A | 10/1975 | Gyongyosi et al. |
| 3,915,244 | A | 10/1975 | Brown |
| 3,934,660 | A | 1/1976 | Nelson |
| 3,935,910 | A | 2/1976 | Gaudy et al. |
| 3,945,444 | A | 3/1976 | Kundson |

3,947,009 A 3/1976 Nelmark
3,948,321 A 4/1976 Owen et al.
3,964,556 A 6/1976 Gearhart et al.
3,980,143 A 9/1976 Swartz et al.
4,049,066 A 9/1977 Richey
4,054,332 A 10/1977 Bryan, Jr.
4,054,426 A 10/1977 White
4,064,939 A 12/1977 Marquis
4,069,573 A 1/1978 Rogers, Jr. et al.
4,077,525 A 3/1978 Callegari et al.
4,082,144 A 4/1978 Marquis
4,083,405 A 4/1978 Shirley
4,085,808 A 4/1978 Kling
4,095,865 A 6/1978 Denison et al.
4,100,968 A 7/1978 Delano
4,100,981 A 7/1978 Chaffin
4,127,168 A 11/1978 Hanson et al.
4,127,927 A 12/1978 Hauk et al.
4,133,396 A 1/1979 Tschirky
4,142,739 A 3/1979 Billingsley
4,159,564 A 7/1979 Cooper, Jr.
4,173,457 A 11/1979 Smith
4,175,619 A 11/1979 Davis
4,182,423 A 1/1980 Ziebarth et al.
4,186,628 A 2/1980 Bonnice
4,189,185 A 2/1980 Kammerer, Jr. et al.
4,194,383 A 3/1980 Huzyak
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,288,082 A 9/1981 Setterberg, Jr.
4,311,195 A 1/1982 Mullins, II
4,315,553 A 2/1982 Stallings
4,319,393 A 3/1982 Pogonowski
4,320,915 A 3/1982 Abbott et al.
4,324,407 A 4/1982 Upham et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,429,620 A 2/1984 Burkhardt et al.
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,469,174 A 9/1984 Freeman
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,531,581 A 7/1985 Pringle et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,588,030 A 5/1986 Blizzard
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,610,320 A 9/1986 Beakley
4,613,161 A 9/1986 Brisco
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,697,640 A 10/1987 Szarka
4,699,224 A 10/1987 Burton
4,708,202 A 11/1987 Sukup et al.
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,770,259 A 9/1988 Jansson
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,828,050 A 5/1989 Hashimoto
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.

4,858,705 A 8/1989 Thiery
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,024,273 A 6/1991 Coone et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,083,608 A 1/1992 Abdrakhmanov et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A * 12/1993 Leturno ..... 175/107
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,303,772 A 4/1994 George et al.
5,305,830 A 4/1994 Wittrisch
5,305,839 A 4/1994 Kalsi et al.
5,311,952 A 5/1994 Eddison et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,343,968 A 9/1994 Glowka
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,409,059 A 4/1995 McHardy
5,433,279 A 7/1995 Tassari et al.
5,435,386 A 7/1995 LaFleur
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,462,120 A 10/1995 Gondouin
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,426 A 10/1996 Trahan et al.
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,611,397 A 3/1997 Wood
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,685,369 A 11/1997 Ellis et al.
5,685,373 A 11/1997 Collins et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,718,288 A 2/1998 Bertet et al.

5,720,356 A 2/1998 Gardes
5,730,221 A 3/1998 Longbottom et al.
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,755,299 A 5/1998 Langford, Jr. et al.
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,791,413 A * 8/1998 Buzinsky ..... 166/123
5,791,416 A 8/1998 White et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,829,539 A 11/1998 Newton et al.
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,540 A 4/1999 Pia et al.
5,890,549 A 4/1999 Sprehe
5,894,897 A 4/1999 Vail, III
5,901,787 A 5/1999 Boyle
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,021,850 A 2/2000 Wood et al.
6,024,169 A 2/2000 Haugen
6,026,911 A 2/2000 Angle et al.
6,029,748 A 2/2000 Forsyth et al.
6,035,953 A 3/2000 Rear
6,056,060 A 5/2000 Abrahamsen et al.
6,059,051 A 5/2000 Jewkes et al.
6,059,053 A * 5/2000 McLeod ..... 175/258
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,085,838 A 7/2000 Vercaemer et al.
6,089,323 A 7/2000 Newman et al.
6,098,717 A 8/2000 Bailey et al.
6,106,200 A 8/2000 Mocivnik et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Åsberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,224,112 B1 5/2001 Eriksen et al.
6,227,587 B1 5/2001 Terral
6,234,257 B1 5/2001 Ciglenec et al.
6,237,684 B1 5/2001 Bouligny, Jr. et al.
6,244,363 B1 6/2001 McLeod
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,050 B2 * 11/2001 Vaynshteyn et al. ..... 166/376
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 5/2002 Mullins
6,392,317 B1 5/2002 Hall et al.
6,397,946 B1 6/2002 Vail, III
6,401,820 B1 6/2002 Kirk et al.
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,425,444 B1 7/2002 Metcalfe et al.
6,427,776 B1 8/2002 Hoffman et al.

6,429,784 B1 8/2002 Beique et al.
6,431,626 B1 8/2002 Bouligny
6,453,257 B1 8/2002 Juhasz et al.
6,443,241 B1 9/2002 Juhasz et al.
6,443,247 B1 9/2002 Wardley
6,446,323 B1 9/2002 Metcalfe et al.
6,446,723 B1 9/2002 Ramos et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,494,272 B1 12/2002 Eppink et al.
6,497,280 B2 12/2002 Beck et al.
6,497,289 B1 12/2002 Cook et al.
6,527,047 B1 3/2003 Pietras
6,527,049 B2 3/2003 Metcalfe et al.
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Metcalfe et al.
6,547,017 B1 4/2003 Vail, III
6,553,825 B1 4/2003 Boyd
6,554,063 B2 4/2003 Ohmer
6,554,064 B1 4/2003 Restarick et al.
6,571,868 B2 6/2003 Victor
6,578,630 B2 6/2003 Simpson et al.
6,585,040 B2 7/2003 Hanton et al.
6,591,471 B1 7/2003 Hollingsworth et al.
6,591,905 B2 7/2003 Coon
6,595,288 B2 7/2003 Mosing et al.
6,612,383 B2 9/2003 Desai et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,640,903 B1 11/2003 Cook et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,029 B2 3/2004 Metcalfe et al.
6,702,040 B1 3/2004 Sensenig
6,705,413 B1 3/2004 Tessari
6,708,769 B2 3/2004 Haugen et al.
6,715,430 B2 4/2004 Choi et al.
6,719,071 B1 4/2004 Moyes
6,722,559 B1 4/2004 Millar et al.
6,725,917 B2 4/2004 Metcalfe
6,725,919 B2 4/2004 Cook et al.
6,725,924 B2 4/2004 Davidson et al.
6,725,938 B1 4/2004 Pietras
6,732,822 B2 5/2004 Slack et al.
6,742,584 B1 6/2004 Appleton
6,742,591 B2 6/2004 Metcalfe
6,742,596 B2 6/2004 Haugen
6,742,606 B2 6/2004 Metcalfe et al.
6,745,834 B2 6/2004 Davis et al.
6,749,026 B2 6/2004 Smith et al.
6,752,211 B2 6/2004 Dewey et al.
6,758,278 B2 7/2004 Cook et al.
6,776,233 B2 8/2004 Meehan
6,802,374 B2 10/2004 Edgar et al.
6,832,656 B2 12/2004 Cameron
6,832,658 B2 12/2004 Keast
6,837,313 B2 1/2005 Hosie et al.
6,840,322 B2 1/2005 Haynes
6,845,820 B1 1/2005 Hebert et al.
6,848,517 B2 2/2005 Wardley
6,854,533 B2 2/2005 Galloway
6,857,486 B2 2/2005 Chitwood et al.
6,857,487 B2 2/2005 Galloway
6,868,906 B1 3/2005 Vail, III et al.
6,877,553 B2 4/2005 Cameron
6,892,819 B2 5/2005 Cook et al.
6,892,835 B2 5/2005 Shahin et al.
6,896,075 B2 5/2005 Haugen et al.
6,899,186 B2 5/2005 Galloway et al.
6,899,772 B1 5/2005 Buytaert et al.
6,920,932 B2 7/2005 Zimmerman
6,923,255 B2 8/2005 Lee
6,926,126 B2 8/2005 Baumann et al.
6,941,652 B2 9/2005 Echols et al.
6,953,096 B2 10/2005 Gledhill et al.
7,000,695 B2 2/2006 Steele et al.
7,004,264 B2 2/2006 Simpson et al.
7,013,992 B2 3/2006 Tessari et al.
7,013,997 B2 3/2006 Vail, III
7,036,610 B1 5/2006 Vail, III
7,040,420 B2 5/2006 Vail, III
7,044,241 B2 5/2006 Angman
7,048,050 B2 5/2006 Vail, III et al.
7,082,997 B2 8/2006 Slack
7,083,005 B2 8/2006 Galloway et al.
7,090,004 B2 8/2006 Warren et al.
7,093,675 B2 8/2006 Pia
7,096,982 B2 8/2006 McKay et al.
7,100,710 B2 9/2006 Vail, III
7,100,713 B2 9/2006 Tulloch
7,108,072 B2 9/2006 Cook et al.
7,108,080 B2 9/2006 Tessari et al.
7,108,083 B2 9/2006 Simonds et al.
7,108,084 B2 9/2006 Vail, III
7,117,957 B2 10/2006 Metcalfe et al.
7,124,825 B2 10/2006 Slack
7,128,154 B2 10/2006 Giroux et al.
7,137,454 B2 11/2006 Pietras
7,140,443 B2 11/2006 Beierbach et al.
7,140,455 B2 11/2006 Walter et al.
7,143,847 B2 12/2006 Pia
7,147,068 B2 12/2006 Vail, III
7,159,668 B2 1/2007 Herrera
7,165,634 B2 1/2007 Vail, III
2001/0000101 A1 4/2001 Lovato et al.
2001/0002626 A1 6/2001 Frank et al.
2001/0013412 A1 8/2001 Tubel
2001/0040054 A1 11/2001 Haugen et al.
2001/0042625 A1 11/2001 Appleton
2001/0045284 A1 11/2001 Simpson et al.
2001/0047883 A1 12/2001 Hanton et al.
2002/0040787 A1 4/2002 Cook et al.
2002/0066556 A1 6/2002 Goode et al.
2002/0074127 A1 6/2002 Birckhead et al.
2002/0074132 A1 6/2002 Juhasz et al.
2002/0079102 A1 6/2002 Dewey et al.
2002/0108748 A1 8/2002 Keyes
2002/0134555 A1 9/2002 Allen et al.
2002/0145281 A1 10/2002 Metcalfe et al.
2002/0157829 A1 10/2002 Davis et al.
2002/0162690 A1 11/2002 Hanton et al.
2002/0166668 A1 11/2002 Metcalfe et al.
2002/0170720 A1 11/2002 Haugen
2002/0189806 A1 12/2002 Davidson et al.
2002/0189863 A1 12/2002 Wardley
2003/0029641 A1 2/2003 Meehan

| | | | |
|---|---|---|---|
| 2003/0034177 | A1 | 2/2003 | Chitwood et al. |
| 2003/0042022 | A1 | 3/2003 | Lauritzen et al. |
| 2003/0056947 | A1 | 3/2003 | Cameron |
| 2003/0056991 | A1 | 3/2003 | Hahn et al. |
| 2003/0070841 | A1 | 4/2003 | Merecka et al. |
| 2003/0070842 | A1 | 4/2003 | Bailey et al. |
| 2003/0111267 | A1 | 6/2003 | Pia |
| 2003/0141111 | A1 | 7/2003 | Pia |
| 2003/0146023 | A1 | 8/2003 | Pia |
| 2003/0164250 | A1 | 9/2003 | Wardley |
| 2003/0164251 | A1 | 9/2003 | Tulloch |
| 2003/0164276 | A1 | 9/2003 | Snider et al. |
| 2003/0173073 | A1 | 9/2003 | Snider et al. |
| 2003/0173090 | A1 | 9/2003 | Cook et al. |
| 2003/0183424 | A1 | 10/2003 | Tulloch |
| 2003/0213598 | A1 | 11/2003 | Hughes |
| 2003/0217865 | A1 | 11/2003 | Simpson et al. |
| 2003/0221519 | A1 | 12/2003 | Haugen et al. |
| 2004/0000405 | A1 | 1/2004 | Fournier, Jr. et al. |
| 2004/0003490 | A1 | 1/2004 | Shahin et al. |
| 2004/0003944 | A1 | 1/2004 | Vincent et al. |
| 2004/0011534 | A1 | 1/2004 | Simonds et al. |
| 2004/0011566 | A1 | 1/2004 | Lee |
| 2004/0016575 | A1 | 1/2004 | Shahin et al. |
| 2004/0060697 | A1 | 4/2004 | Tilton et al. |
| 2004/0060700 | A1 | 4/2004 | Vert et al. |
| 2004/0069500 | A1 | 4/2004 | Haugen |
| 2004/0069501 | A1 | 4/2004 | Haugen et al. |
| 2004/0079533 | A1 | 4/2004 | Buytaert et al. |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0112693 | A1 | 6/2004 | Baumann et al. |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0182579 | A1 | 9/2004 | Steele et al. |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0238218 | A1 | 12/2004 | Runia et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0011643 | A1 | 1/2005 | Slack et al. |
| 2005/0077048 | A1 | 4/2005 | Hall |
| 2005/0096846 | A1 | 5/2005 | Koithan et al. |
| 2005/0152749 | A1 | 7/2005 | Anres et al. |
| 2005/0183892 | A1 | 8/2005 | Oldham et al. |
| 2005/0274547 | A1 | 12/2005 | Fincher et al. |
| 2006/0070771 | A1 | 4/2006 | McClain et al. |
| 2007/0068703 | A1 | 3/2007 | Tessari et al. |
| 2007/0079995 | A1 | 4/2007 | McClain et al. |

FOREIGN PATENT DOCUMENTS

| | | |
|---|---|---|
| EP | 0 171 144 | 2/1986 |
| EP | 0 235 105 | 9/1987 |
| EP | 0 265 344 | 4/1988 |
| EP | 0 285 386 | 10/1988 |
| EP | 0 397 323 | 11/1990 |
| EP | 0 426 123 | 5/1991 |
| EP | 0 462 618 | 12/1991 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| GB | 540 027 | 10/1941 |
| GB | 709 365 | 5/1954 |
| GB | 709365 | 5/1954 |
| GB | 716 761 | 10/1954 |
| GB | 716761 | 10/1954 |
| GB | 733596 | 7/1955 |
| GB | 7 928 86 | 4/1958 |
| GB | 8 388 33 | 6/1960 |
| GB | 881 358 | 11/1961 |
| GB | 881358 | 11/1961 |
| GB | 887150 | 1/1962 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 221 482 | 7/1990 |
| GB | 2 224 481 | 9/1990 |
| GB | 2 239 918 | 7/1991 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 320 734 | 7/1998 |
| GB | 2 324 108 | 10/1998 |
| GB | 2 326 896 | 1/1999 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| GB | 2 396 375 | 6/2004 |
| WO | WO 82/01211 | 4/1982 |
| WO | WO 90/06418 | 6/1990 |
| WO | WO 91/16520 | 10/1991 |
| WO | WO 92/01139 | 1/1992 |

| | | |
|---|---|---|
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 98/01651 | 1/1998 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/18328 | 4/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/37772 | 6/2000 |
| WO | WO 00/37773 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00/50730 | 8/2000 |
| WO | WO 00/50732 | 8/2000 |
| WO | WO 00/66879 | 11/2000 |
| WO | WO 00/77431 | 12/2000 |
| WO | WO 01/12946 | 2/2001 |
| WO | WO 01/46550 | 6/2001 |
| WO | WO 01/60545 | 8/2001 |
| WO | WO 01/66901 | 9/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/29199 | 4/2002 |
| WO | WO 02/44601 | 6/2002 |
| WO | WO 02/081863 | 10/2002 |
| WO | WO 02/086287 | 10/2002 |
| WO | WO 02/092956 | 11/2002 |
| WO | WO 03/006790 | 1/2003 |
| WO | WO 03/074836 | 9/2003 |
| WO | WO 03/087525 | 10/2003 |
| WO | WO 2004/022903 | 3/2004 |

OTHER PUBLICATIONS

Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.

Tommy Warren, SPE, Bruce Houtchens,, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Valves Wellhead Equipment Safety Systems, W-K-M Division, ACF Industries, Catalog 80, 1980, 5 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving The Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

Alexander Sas-Jaworsky and J. G. Williams, Development of Composite Coiled Tubing For Oilfield Services, SPE 26536, Society of Petroleum Engineers, Inc., 1993.

A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.

G. F. Boykin, The Role of A WorldWide Drilling Organization and the Road to the Future, SPE/IADC 37630, 1997.

M. S. Fuller, M. Littler, and I. Pollock, Innovative Way To Cement a Liner Utilizing a New Inner String Liner Cementing Process, 1998.

Helio Santos, Consequences and Relevance of Drillstring Vibration on Wellbore Stability, SPE/IADC 52820, 1999.

Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.

C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.

Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.

Mike Bullock, Tom Grant, Rick Sizemore, Chan Daigle, and Pat York, Using Expandable Solid Tubulars To Solve Well Construction Challenges In Deep Waters And Maturing Properities, IBP 27500, Brazilian Petroleum Institute—IBP, 2000.

Coiled Tubing Handbook, World Oil, Gulf Publishing Company, 1993.

Multilateral Case History, Onshore-Nigeria, Baker Hughes, 2000.

Multilateral Case History, Offshore Norway, Baker Hughes, 1995.

Tommy Warren, Bruce Houtchens, and Garrett Madell, Directional Drilling With Casing, SPE/IADC 79914, SPE/IADC Drilling Conference, Amsterdam, The Netherlands, Feb. 19-21, 2003, pp. 1-10.

PCT Search Report, International Application No. PCT/US2004/006748, dated Oct. 21, 2004.

Yakov A. Gelfgat, Mikhail Y. Gelfgat and Yuri S. Lopatin, *Retractable Drill Bit Technology—Drilling Without Pulling Out Drillpipe*, Advanced Drilling Solutions Lessons From the FSU; Jun. 2003; vol. 2, pp. 351-464.

Tommy Warren, SPE, Bruce Houtchens, SPE, Garret Madell, SPE, *Directional Drilling With Casing*, SPE/IADC 79914, Tesco Corporation, SPE/IADC Drilling Conference, 2003.

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.

M.B. Stone and J. Smith, "Expandable Tubulars and Casing Drilling are Options" Drilling Contractor, Jan./Feb. 2002, pp. 52.

M. Gelfgat, "Retractable Bits Development and Application" Transactions of the ASME, vol. 120, Jun. 1998, pp. 124-130.
"First Success with Casing-Drilling" Word Oil, Feb. 1999, pp. 25.
Dean E. Gaddy, Editor, "Russia Shares Technical Know-How with U.S." Oil & Gas Journal, Mar. 1999, pp. 51-52 and 54-56.
U.S. Appl. No. 10/794,800, filed Mar. 5, 2004.
U.S. Appl. No. 10/832,804, filed Apr. 27, 2004.
U.S. Appl. No. 10/795,214, filed Mar. 5, 2004.
U.S. Appl. No. 10/794,795, filed Mar. 5, 2004.
U.S. Appl. No. 10/775,048, filed Feb. 9, 2004.
U.S. Appl. No. 10/772,217, filed Feb. 2, 2004.
U.S. Appl. No. 10/788,976, filed Feb. 27, 2004.
U.S. Appl. No. 10/794,797, filed Mar. 5, 2004.
U.S. Appl. No. 10/767,322, filed Jan. 29, 2004.
U.S. Appl. No. 10/795,129, filed Mar. 5, 2004.
U.S. Appl. No. 10/794,790, filed Mar. 5, 2004.
U.S. Appl. No. 10/162,302, filed Jun. 4, 2004.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
U.S. Appl. No. 10/618,093.
U.S. Appl. No. 10/189,570.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach to Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfield, et al., "Burst and Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono-Santos, et al., "Drilling With Casing Advances To Floating Drilling Unit With Surface BOP Employed," Paper WOCD-0307-

01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-27.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Partial PCT Search Report, International Application No. PCT/US2004/006748, dated Aug. 3, 2004.
Charles O. Vail and Verne Smith, New Developments In Air-Gas Drilling and Completions, World Oil, Part One, Nov. 1963, pp. 70-73.
Charles O. Vail and Verne Smith, New Developments In Air-Gas Drilling and Completions, World Oil, Part Two, Dec. 1963, pp. 82-86.

* cited by examiner

FIG. 2A
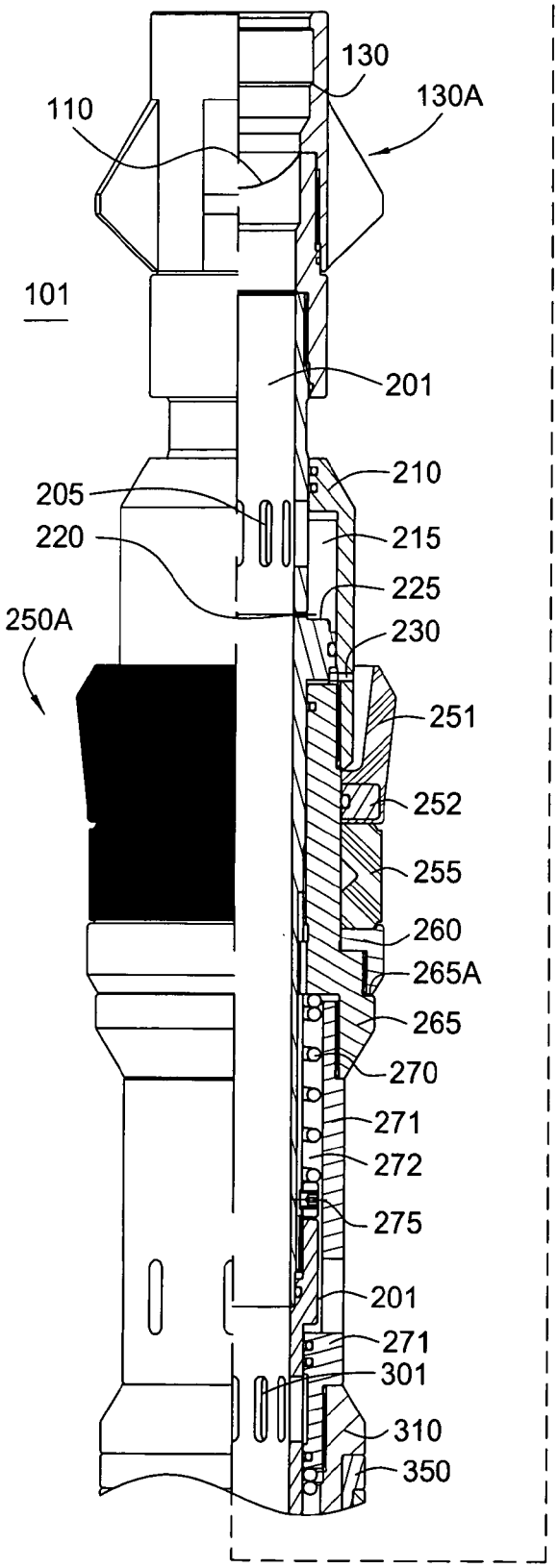
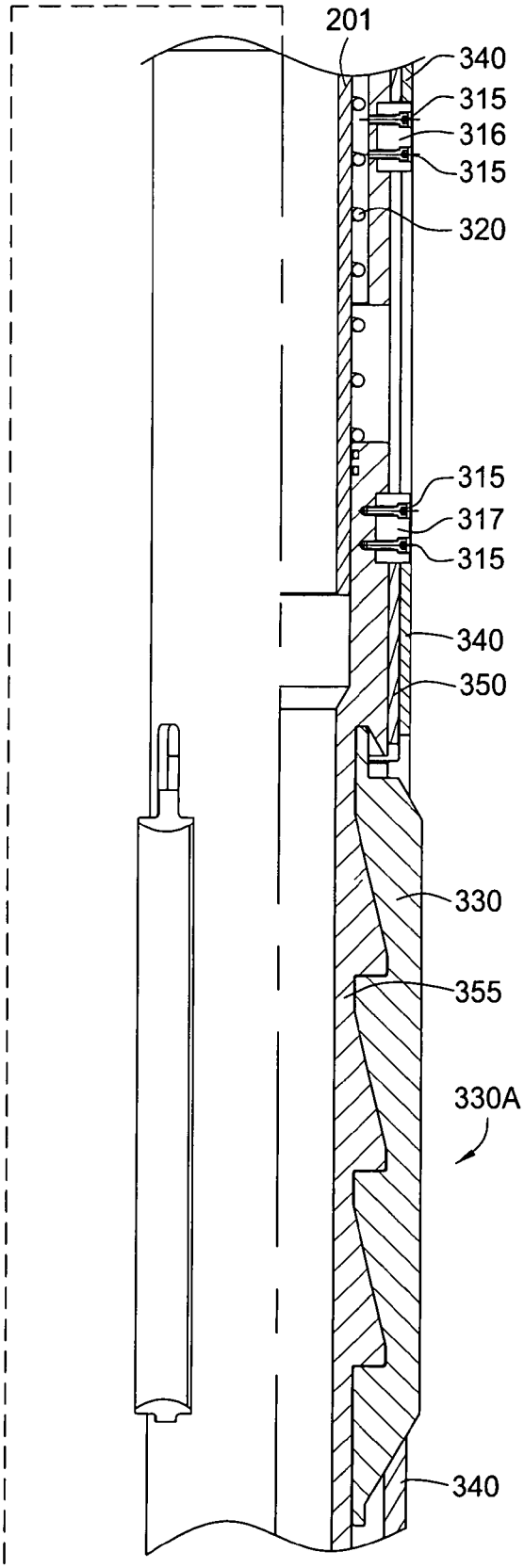
FIG. 2B

FIG. 3A
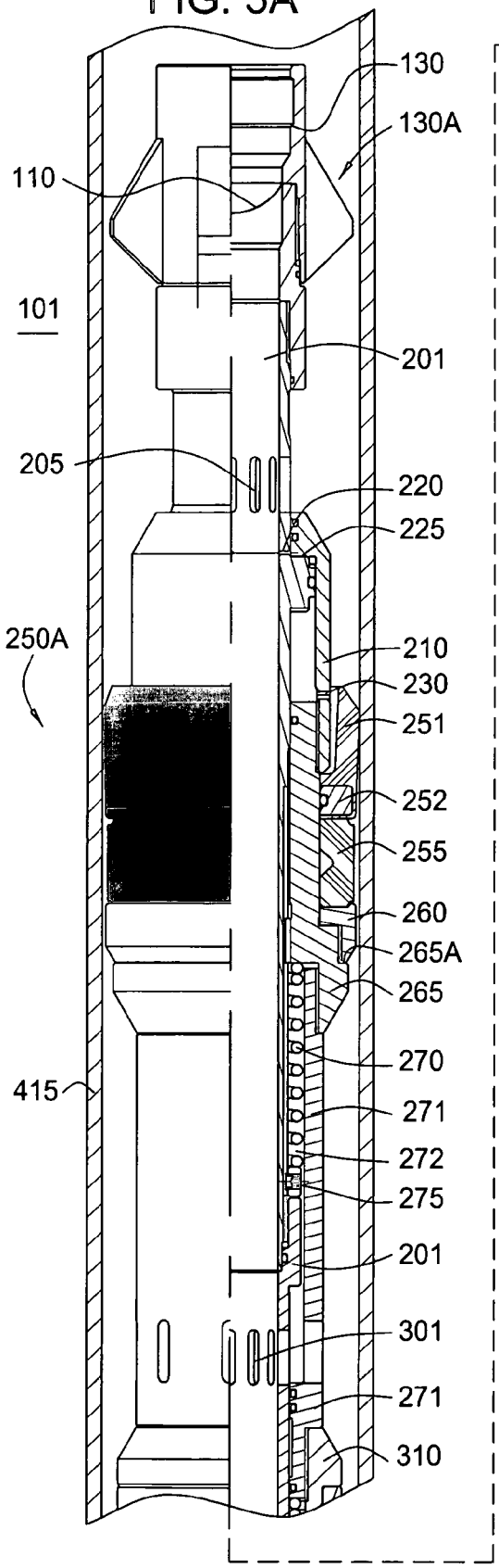
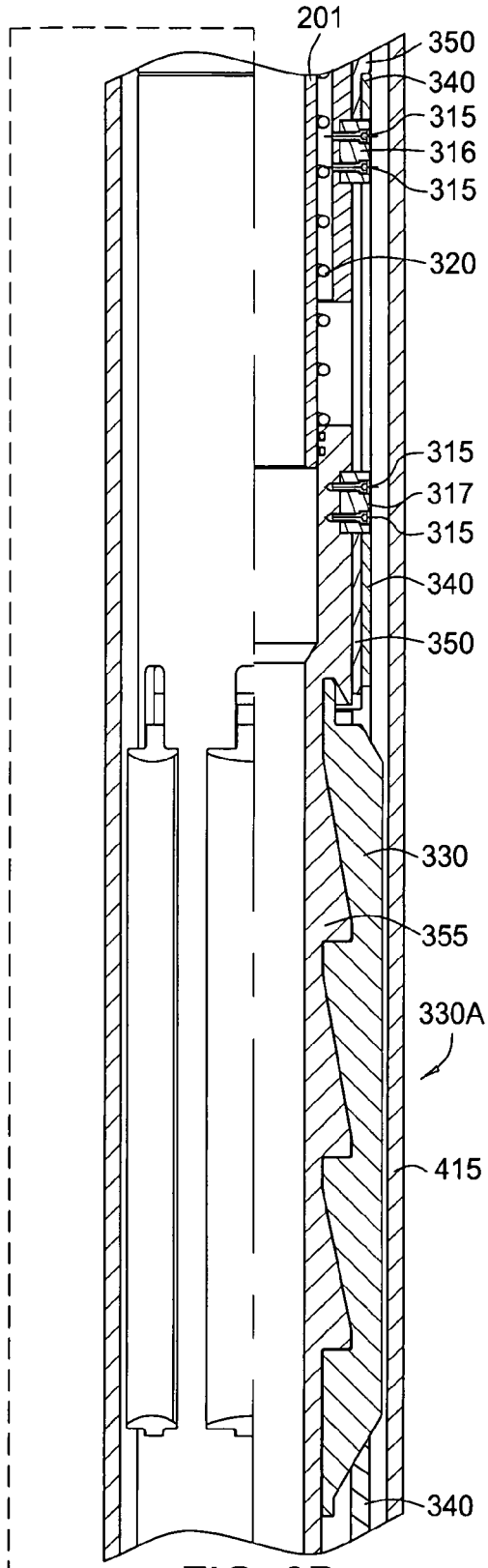
FIG. 3B

FIG. 4A
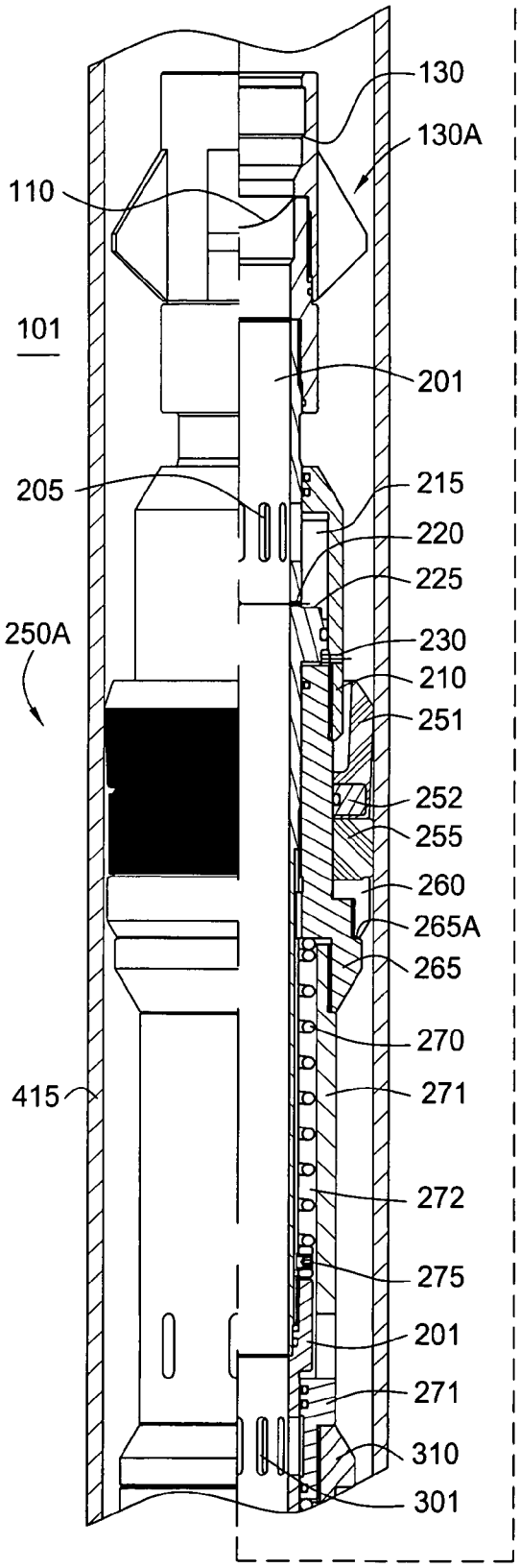
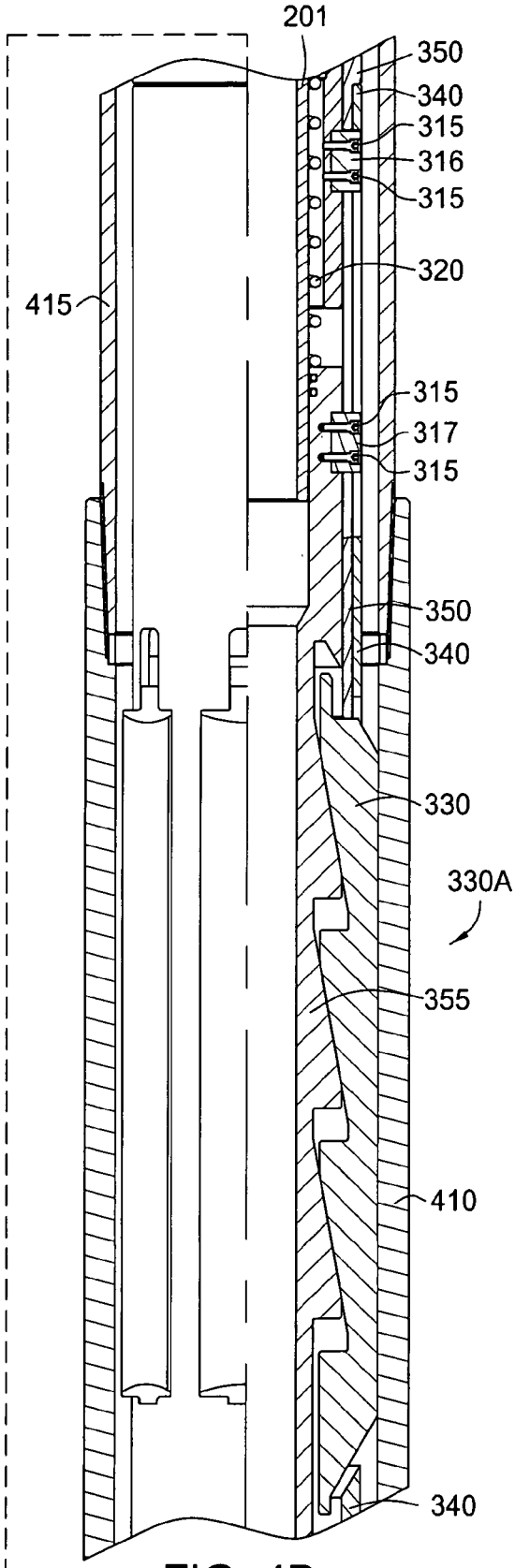
FIG. 4B

FIG. 5A
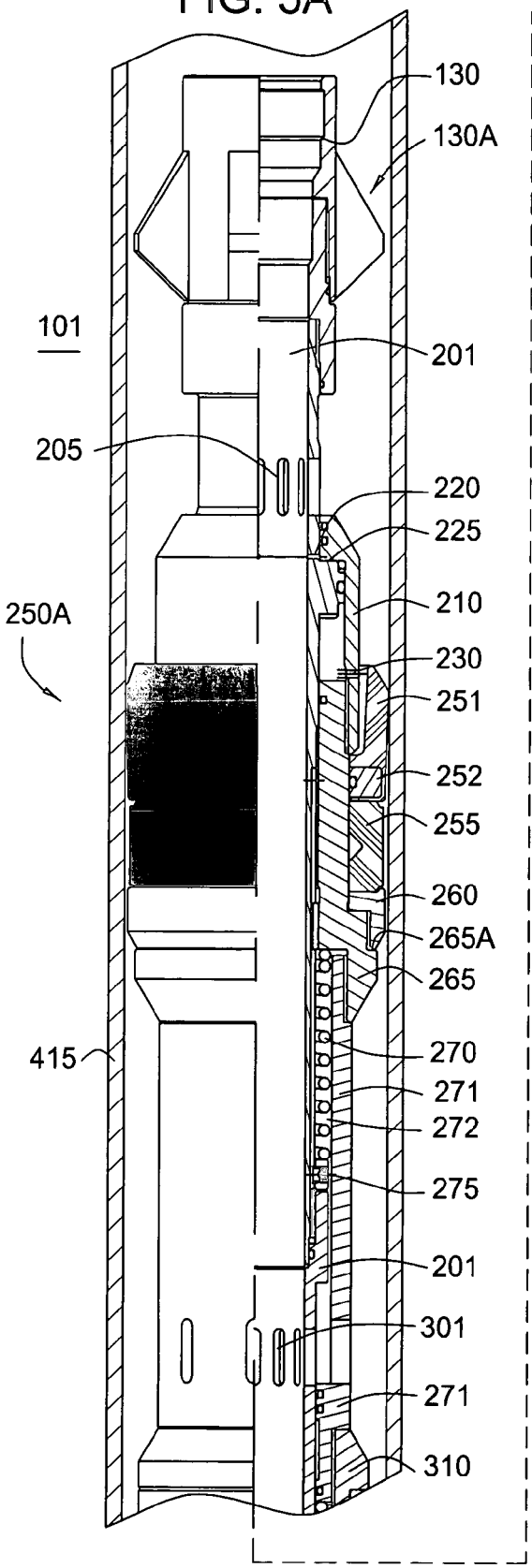
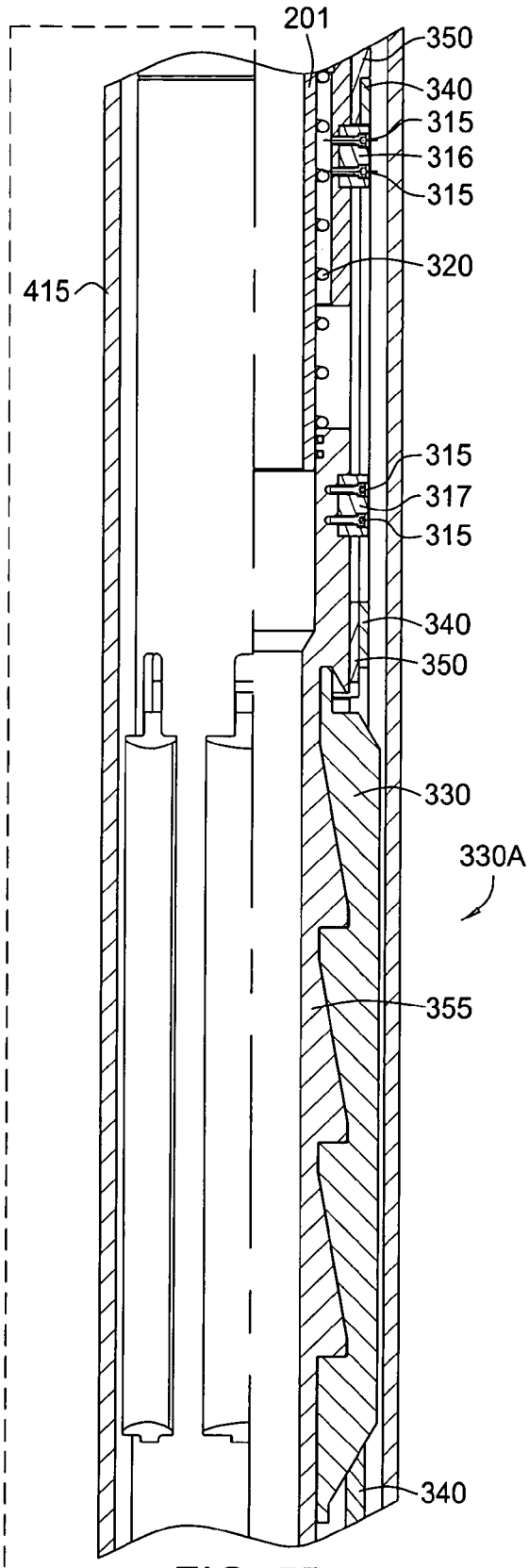
FIG. 5B

FIG. 10A
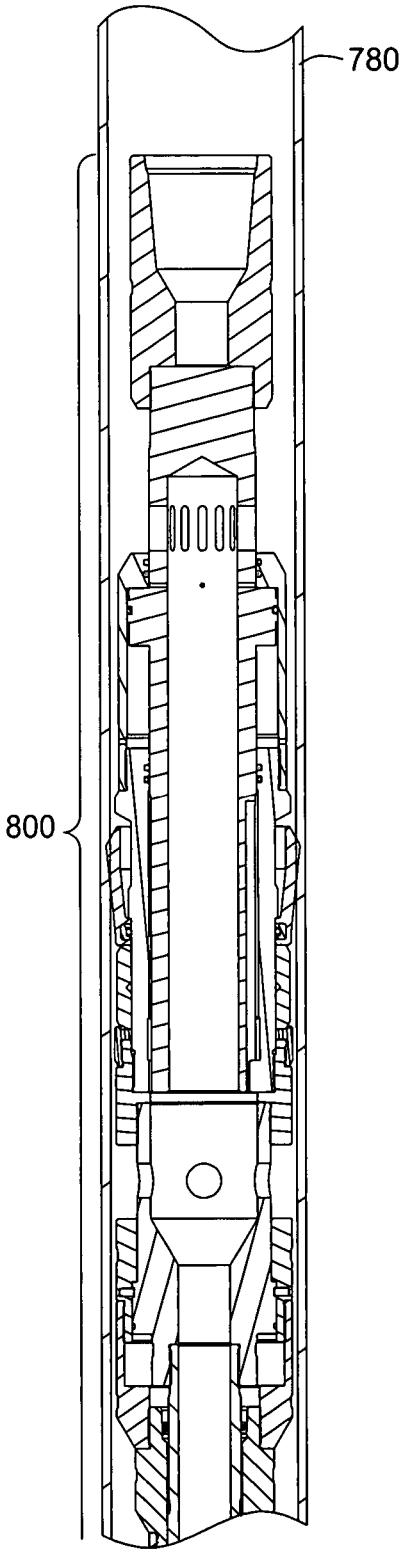
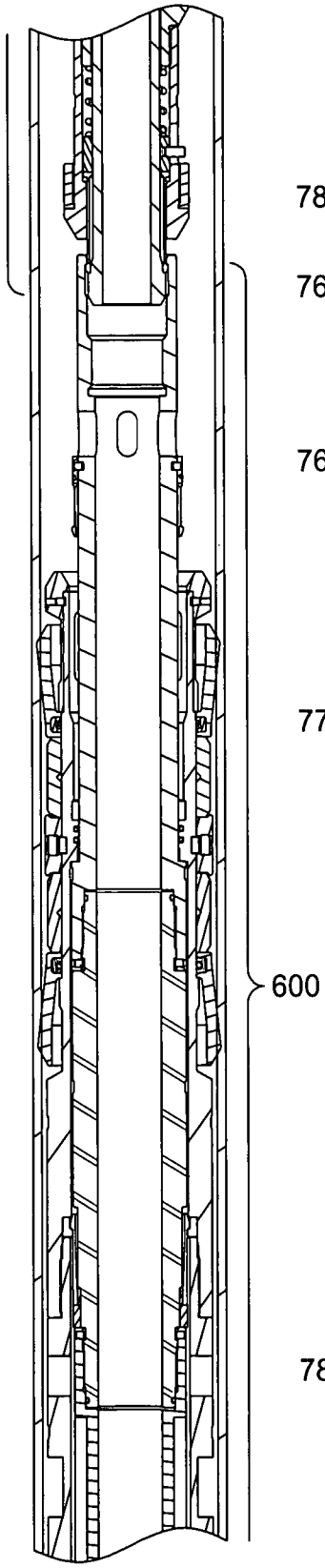
FIG. 10B
FIG. 10C
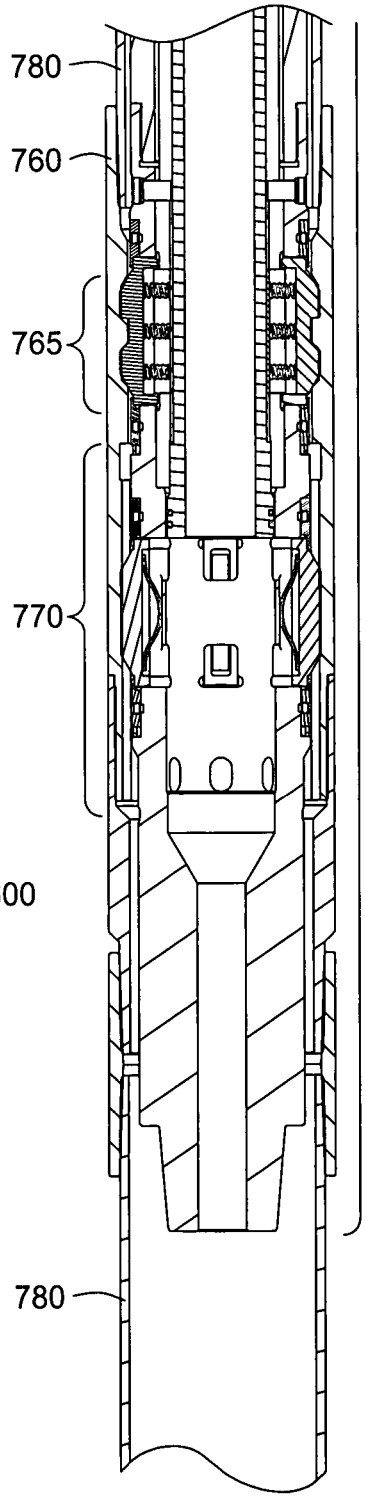

FIG. 11A
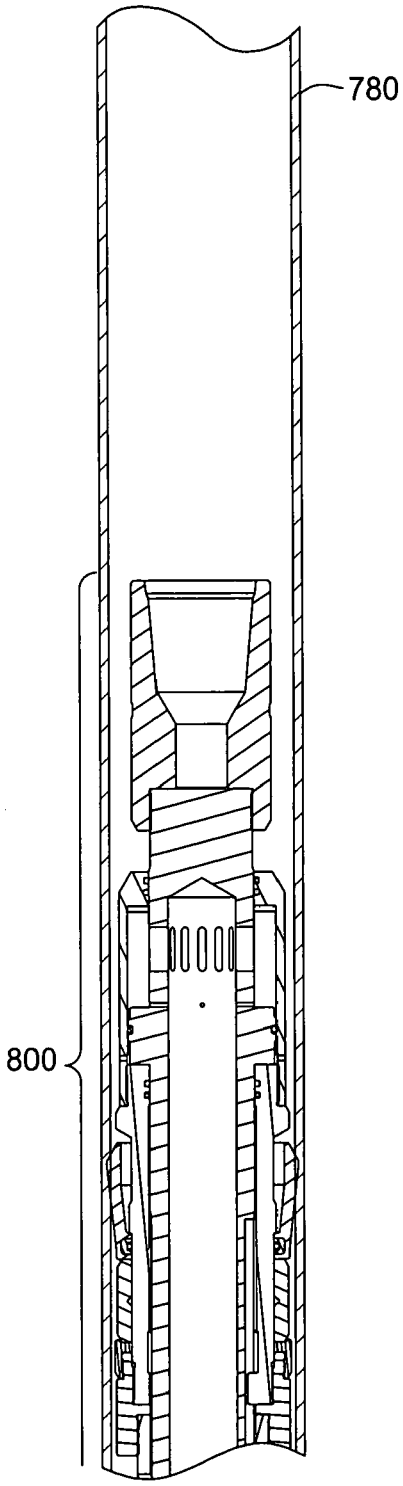
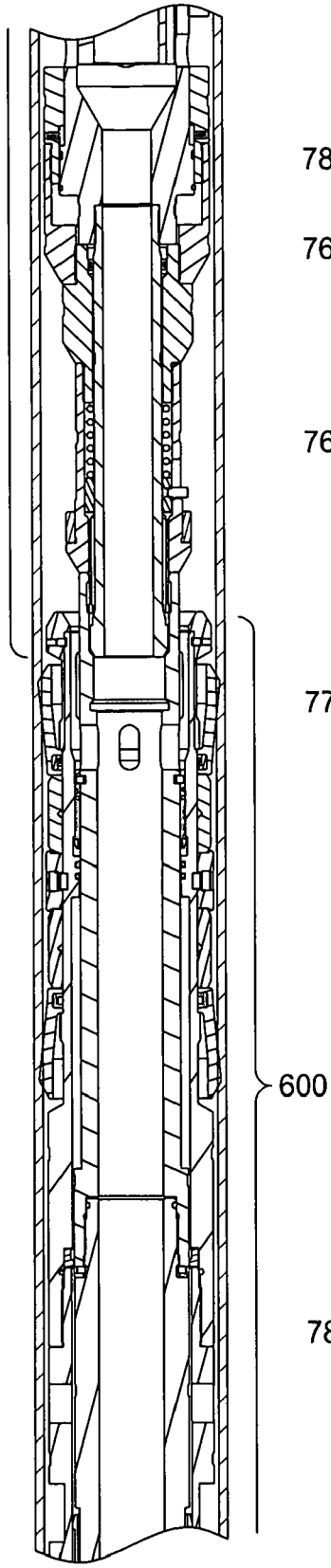
FIG. 11B
FIG. 11C
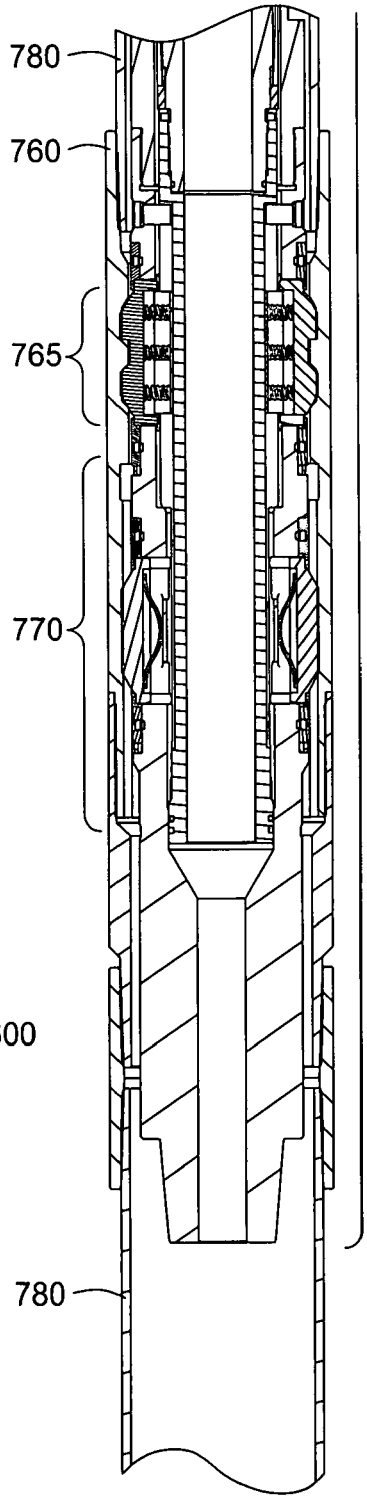

DRILLING WITH CASING LATCH

CROSS-REFERENCE TO RELATED APPLICATIONS

This application claims benefit of U.S. provisional Patent Application Ser. No. 60/452,200, filed Mar. 5, 2003.

BACKGROUND OF THE INVENTION

1. Field of the Invention

The present invention relates to methods and apparatus for forming a wellbore by drilling with casing. More specifically, the invention relates to a retrievable latch for connecting a bottom hole assembly to casing.

2. Description of the Related Art

In well completion operations, a wellbore is formed to access hydrocarbon-bearing formations by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. The casing string is cemented into the wellbore by circulating cement into the annular area defined between the outer wall of the casing and the borehole using apparatuses known in the art. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with a drill bit on a drill string. The drill string is removed. A first string of casing or conductor pipe is then run into the wellbore and set in the drilled out portion of the wellbore, and cement is circulated into the annulus behind the casing string. Next, the well is drilled to a second designated depth, and a second string of casing, or liner, is run into the drilled out portion of the wellbore. The second string is set at a depth such that the upper portion of the second string of casing overlaps the lower portion of the first string of casing. The second liner string may then be fixed, or "hung" off of the existing casing by the use of slips which utilize slip members and cones to frictionally affix the new string of liner in the wellbore. The second casing string is then cemented. This process is typically repeated with additional casing strings until the well has been drilled to total depth. In this manner, wells are typically formed with two or more strings of casing of an ever-decreasing diameter.

As more casing strings are set in the wellbore, the casing strings become progressively smaller in diameter to fit within the previous casing string. In a drilling operation, the drill bit for drilling to the next predetermined depth must thus become progressively smaller as the diameter of each casing string decreases. Therefore, multiple drill bits of different sizes are ordinarily necessary for drilling in well completion operations.

Well completion operations are typically accomplished using one of two methods. The first method involves first running the drill string with the drill bit attached thereto into the wellbore to drill a hole in which to set the casing string. The drill string must then be removed. Next, the casing string is run into the wellbore on a working string and set within the hole. These two steps are repeated as desired with progressively smaller drill bits and casing strings until the desired depth is reached. For this method, two run-ins into the wellbore are required per casing string that is set into the wellbore.

The second method of performing well completion operations involves drilling with casing. In this method, the casing string is run into the wellbore along with a drill bit, which may be part of a bottom hole assembly (BHA). The BHA is operated by rotation of the casing string from the surface of the wellbore or a motor as part of the BHA. After the casing is drilled and set into the wellbore, the first BHA is retrieved from the wellbore. A smaller casing string with a second BHA attached thereto is run into the wellbore, through the first casing. The second BHA is smaller than the first BHA so that it fits within the second, smaller casing string. The second, smaller BHA then drills a hole for the placement of the second casing. Afterwards, the second BHA is retrieved, and subsequent assemblies comprising casing strings with BHAs attached thereto are operated until the well is completed to a desired depth.

One problem noticed in drilling with casing operations is attaching and retrieving the drill bit from the wellbore. In conventional methods, the drill bit is fixably attached to the end of the casing and must be drilled-out using a subsequent casing and drill bit assembly. In other conventional methods, the drill bit is attached to the casing using a retrievable latch. However, a problem that arises using a latch assembly is that foreign matter or debris can prevent or impede either the activation or retrieval of the latch. For example, foreign matter may become lodged or wedged behind expanded components that must be retracted for the latch to disengage from the surrounding casing. In these instances, in order to resume drilling operations, the BHA must be retrieved from the hole, replaced, and run back in, consuming valuable time and generating cost.

Another problem noticed with existing retrievable latches is their complexity. The complexity of these latches may result in low reliability and high cost. Further, these complex designs may require multiple steps to disengage the latch from the casing.

Therefore, a need exists for a latch that attaches a BHA to a casing string, which can be reliably activated and retrieved from the wellbore. There is also a need for a latch that prevents foreign matter and debris from impeding or preventing its intended operations. Further, there is a need for a relatively simple latch that may easily be disengaged from the casing.

SUMMARY OF THE INVENTION

A latch assembly, and methods of using the latch assembly, for use with a bottom hole assembly (BHA) and a tubular, are provided.

In one embodiment, the latch assembly is disposable within the tubular, configured to be rotationally and axially coupled to the tubular.

In one aspect of the embodiment, latch assembly is configured to be released from the tubular by applying a tensile force to the latch assembly. The latch the latch assembly may comprise: one or more sleds disposed within one or more respective slots formed along at least a portion of a locking, mandrel; and one or more retractable axial drag blocks configured to engage a matching axial profile disposed in the tubular, wherein each axial drag block is coupled to the respective sled with one or more biasing members; and the locking mandrel actuatable between a first position and a second position and preventing retraction of the axial drag blocks when actuated to the second position. The latch assembly may also comprise a drag block body having a bore therethorugh; and one or more retractable torsional drag blocks configured to engage a matching torsional profile disposed in the tubular, wherein each torsional drag block is coupled to the drag block body with a biasing member. The drag block body may have one or more ports disposed through a wall thereof. The locking mandrel may close these ports when actuated to the second position. The latch assembly may further comprise one or more cup rings sealingly engageable with the tubular; and one or more packer rings, wherein each cup ring is configured to expand each packer ring into sealing engagement with the tubular when an actuation pressure is exerted on each cup ring. The latch assembly may further comprise two releasable latch mechanisms, each securing the latch assembly in the first or second positions. The latch assembly may further comprise a setting tool releasably coupled to the mandrel, wherein the setting tool is configured to transfer a first force to the latch assembly applied to the setting tool by either a run in device or fluid pressure and to release the mandrel upon application of a second force to the setting tool by the run in device or fluid pressure In another aspect of the embodiment, the latch assembly may comprise: a packing element sealingly engageable with the tubular, disposed along and coupled to a packer mandrel, and coupled to a packer compression member; and the packer compression member releasably coupled to the packer mandrel with a ratchet assembly, wherein the packing element will be held in sealing engagement with the tubular when actuated by a setting force and released from sealing engagement with the tubular when the packer compression member is released from the packer mandrel by a releasing force.

In yet another aspect of the embodiment, the latch assembly may comprise a body having a bore formed therethrough and disposable within the surrounding tubular. The latch assembly may further comprise a pressure balance bypass assembly disposed about the body. The pressure balance bypass assembly comprises a first set of one or more ports formed through the body and a second set of one or more ports formed through the body. The latch assembly may further comprise a cup assembly disposed about the body, and a slip assembly disposed about the body.

In another embodiment, n annular sealing assembly for sealing an annulus between a downhole tool and a tubular is provided, comprising: one or more cup rings sealingly engageable with the tubular; and one or more packer rings, wherein each cup ring is configured to expand each packer ring into sealing engagement with the tubular when an actuation pressure is exerted on each cup ring.

In yet another embodiment, a method of installing a latch assembly in a tubular is provided, comprising: running a latch assembly into the tubular using a run in device; setting the latch assembly, thereby axially and rotationally coupling the latch assembly to the tubular; and exerting a tensile force on the latch assembly, thereby releasing the latch assembly from the tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 2A-2C illustrate a partial cross section view of the latch assembly shown in FIG. 1.

FIGS. 3A-C illustrate a partial cross section view of the latch assembly of FIG. 1 within a tubular in a run-in position having an open pressure balanced bypass system.

FIGS. 4A-C illustrate a partial cross section view of the latch assembly of FIG. 1 locked in position by the engaged key assembly and the activated slips against the tubular.

FIGS. 5A-C illustrate a partial cross section view of the latch assembly of FIG. 1 having an activated or open pressure balanced bypass system being pulled out of the tubular 415.

FIGS. 10A-C show the latch assembly of FIGS. 8A-B coupled to the setting tool of FIGS. 9A-B and a BHA (not shown) having been run into a string of casing using a known run in device (not shown), wherein the latch assembly and setting tool are in an open position.

FIGS. 11A-C show the latch assembly of FIGS. 8A-B coupled to the setting tool of FIGS. 9A-B and the BHA (not shown) disposed in the casing, wherein the latch assembly is in a closed position.

DETAILED DESCRIPTION OF THE PREFERRED EMBODIMENT

A latch assembly for securing a bottom hole assembly (BHA) to a section of tubular to be run into a wellbore is provided. The tubulars 415, 780 may include casing or any other tubular members such as piping, tubing, drill string, and production tubing, for example. The BHA may be any tool used to drill, repair, or maintain the well bore. Exemplary BHA's include drill bits, measurement while drilling (MWD), logging while drilling (LWD), and wellbore steering mechanisms, for example. In the Figures, many of the parts are sealingly coupled with O-rings and/or coupled with set screws. Since this is well known to those skilled in the art, the o-rings and set screws may not be separately labeled or discussed. Further, for the sake of convenience, various pins, screws, etc. have not been cross-hatched in various section views even though they are cut in those sections. For ease and clarity of description, the latch assemblies 101, 501, 600 and setting tool 800 will be further described in more detail below as if disposed within the respective tubulars 415, 780 in a vertical position as oriented in the Figures. It is to be understood, however, that the latch assemblies 101, 501, 600 and setting tool 800 may be disposed in any orientation, whether vertical or horizontal. Therefore, reference to directions, i.e., upward or downward, is relative to the exemplary vertical orientation.

Figure 1:
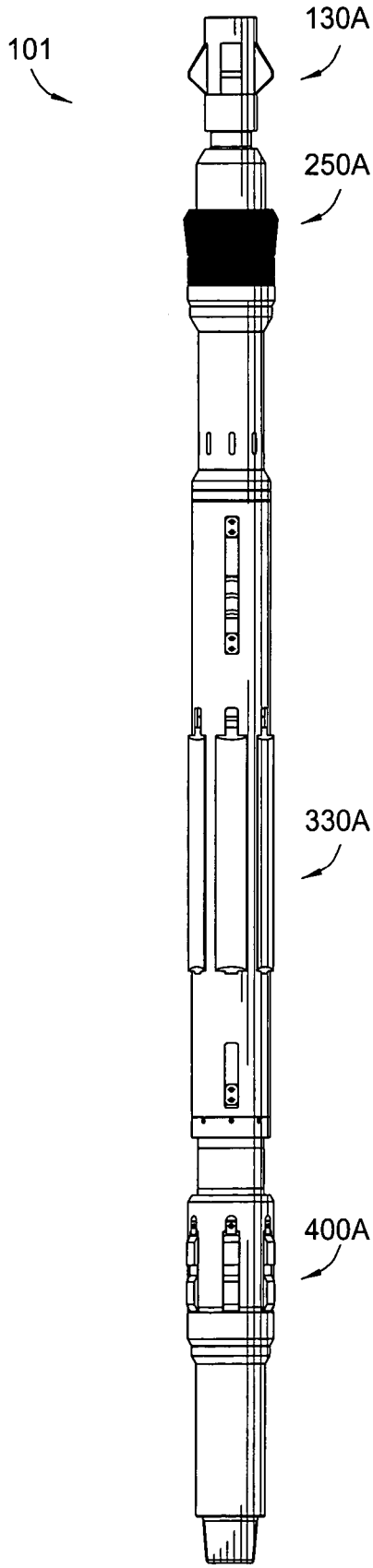
FIG. 1 shows a schematic side view of a latch assembly according to one embodiment of the invention described herein.

FIG. 1 shows a schematic side view of a latch assembly 101 according to one embodiment of the invention described herein. The latch assembly 101 is in an un-set, closed position. Preferably, the latch assembly 101 is configured to open (see FIGS. 3A-C) when supported from a retrieval assembly 130A. Therefore, in this position, the latch assembly 101 may be supported at a lower end thereof or may be laying on its side. The latch assembly 101 includes the retrieval assembly 130A, a cup assembly 250A, a slip assembly 330A, and a key assembly 400A. The latch assembly 101 is in communication with the surface of a wellbore at a first end thereof, and the BHA (not shown) is attachable to the latch assembly 101 at a second end thereof.

Figure 2C:
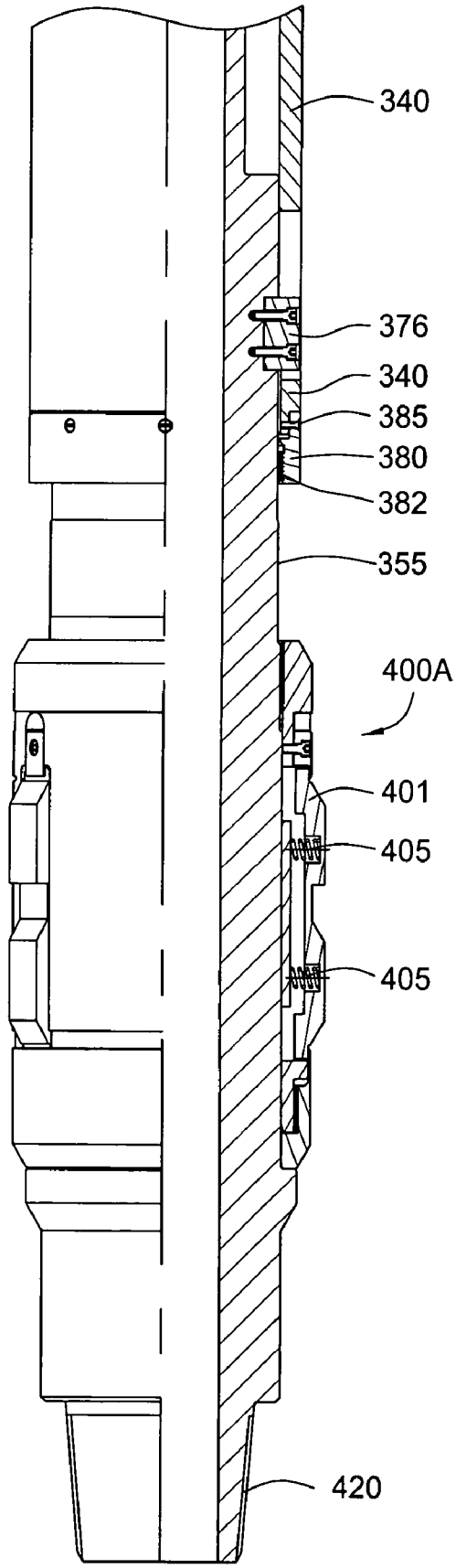

FIGS. 2A-2C illustrate a partial cross section view of the latch assembly 101 shown in FIG. 1, also in an un-set, closed position. FIG. 2A shows a partial cross section view of a first portion of the latch assembly 101. The first portion of the latch assembly 101 includes a bypass mandrel 201, the retrieval assembly 130A, a rupture disk 110, and the cup assembly 250A. The bypass mandrel 201 has sections which are threadably connected, hereinafter, the bypass mandrel will be discussed as one piece. The bypass mandrel 201 includes two or more sets of bypass ports (205 and 301) formed therethrough. The two or more sets of bypass ports form a pressure balanced bypass system, which allows the assembly 101 to be run in a wellbore and pulled out of a wellbore without surging or swabbing the well.

The retrieval assembly 130A includes a retrieval profile 130 disposed about the bypass mandrel 201. The retrieval profile 130 may be connected to a spear (not shown) to run the latch assembly 101 into a surrounding tubular using a wireline, coiled tubing, drill pipe, or any other run in device well known in the art. The rupture disk 110 is disposed within the bypass mandrel 201 and adjacent to the retrieval profile 130 to prevent fluid flow through the latch assembly 101 until a force sufficient to break the rupture disk 110 is applied. If the run-in device is one capable of applying a downward force on the latch assembly 101, then the rupture disk 110 is not required and may be omitted.

The cup assembly 250A forms a seal when expanded thereby isolating an annulus formed between the latch assembly 101 and the surrounding tubular 415. One or more cup assemblies 250A may be used. For simplicity and ease of description, the cup assembly 250A will be described below in more detail as shown in FIGS. 2A-2C. The cup assembly 250A includes a cup ring 251, a packer ring 255, and a gage ring 260 each disposed about the bypass mandrel 201. The cup ring 251, the packer ring 255, and the gage ring 260 are also disposed about and supported on an outer diameter of a cup mandrel 265.

The cup ring 251 is an annular member open at a first end thereof and is sealed at a second end by an o-ring. Disposed within the second end of the cup ring 251, is an o-ring retainer 252. Preferably, the o-ring retainer 252 is formed from brass or aluminum and is molded within the cup ring 251. The first end of the cup ring 251 has an increasing inner diameter flaring outward from a housing 210. The first end of the cup ring 251 creates a space or a void between an inner surface thereof and the housing 210. The housing 210 extends into the void and abuts the cup ring 251 to aid in retaining the cup ring in place. The resulting void allows fluid pressure to enter the cup ring 251 and exert an outward radial force against the first end thereof, pushing the cup ring 251 against the surrounding tubular 415. The fluid pressure will also exert a downward force on the cup ring 251. The cup ring 251 may have only limited sealing ability. When the fluid pressure reaches a point near the sealing limit of the cup ring 251, the downward force will be sufficient to expand the packer ring 255 outward from the cup mandrel providing a much greater sealing ability.

The packer ring 255 is also an annular member and is disposed between the cup ring 251 and the gage ring 260. The packer ring 255 expands outward from the cup mandrel 265 when compressed axially between the cup ring 251 and the gage ring 260 by sufficient fluid pressure acting on the cup ring 251. The cup ring 251, itself, may be sufficient to seal the annulus created between the latch assembly 101 and the surrounding tubular 415, especially if the run in device is one capable of applying a downward force on the latch assembly 101. Therefore, the packer ring 255 may be omitted.

The cup ring 251 and the packer ring 255 may have any number of configurations to effectively seal the annulus created between the latch assembly 101 and the surrounding tubular 415. For example, the rings 251, 255 may include grooves, ridges, indentations, or extrusions designed to allow the ring 251, 255 to conform to variations in the shape of the interior of the tubular 415 there-around. The rings 251, 255 can be constructed of any expandable or otherwise malleable material which creates a permanent set position and stabilizes the latch assembly 101 relative to the tubular 415. For example, the rings 251, 255 may be a metal, a plastic, an elastomer, or any combination thereof.

The gage ring 260 is also an annular member and is disposed against a shoulder 265A formed within the outer surface of the cup mandrel 265. The gage ring 260 is made from a non-elastic material and is threadably attached to the cup mandrel 265. The gage ring 260 acts as an axial stop for the cup ring 251 and the packer ring 260, allowing the cup ring 251 and the packer ring 255 to expand radially to form a fluid seal with the surrounding tubular 415 as described above.

The cup assembly 250A further includes the housing 210 disposed adjacent the first set of bypass ports 205 formed within the bypass mandrel 201. The housing 210 is threadably engaged with the cup mandrel 265, allowing the housing 210 to transfer axial forces to and from the cup mandrel 265. The housing 210 also acts to open and close fluid access to the first set of bypass ports 205 by shifting axially across the bypass mandrel 201.

One or more first equalization ports 220 are formed through the bypass mandrel 201, between the housing 210 and the cup mandrel 265. The one or more first equalization ports 220 displace fluid from a first plenum 215 to the annulus surrounding the latch assembly 101, as the housing 210 shifts axially towards shoulder 225 (from FIG. 2A to 3A), and break the vacuum that may be formed within the plenum 215 as the housing 210 shifts axially away from shoulder 225 (from. FIG. 3A to 4A). The first plenum 215 is defined by a portion of an inner diameter of the housing 210 and a portion of an outer diameter of the bypass mandrel 201. One or more second equalization ports 230 are formed through the housing 210 adjacent to the second end of the cup ring 251. The one or more second equalization ports 230 displace fluid from a second plenum (from FIG. 3A to 4A) to the annulus surrounding the latch assembly 101 as the housing 210 shifts axially.

Still referring to the first portion of the latch assembly 101, a bypass sleeve 271 is disposed about the bypass mandrel 201 adjacent the cup mandrel 265. The sleeve 271 and the cup mandrel 265 are threadably connected to transfer axial forces there-between. The bypass sleeve 271 forms a cavity 272 between an inner diameter thereof and an outer diameter of the bypass mandrel 201. A spring 270 is disposed within the cavity 272 and is housed therein by the cup mandrel 265 and a spring stop 275. The bypass sleeve 271 is also disposed adjacent to the second set of bypass ports 301 formed in the bypass mandrel 201, has a slot therethrough, and moves axially across the bypass mandrel 201 to open and close fluid access to the second set of bypass ports 301.

FIG. 2B shows a partial cross section of a second portion of the latch assembly 101. The second portion of the latch assembly 101 includes the slip assembly 330A disposed about a slip mandrel 355. The slip assembly 330A includes one or more slips 330 and a block case 310. The slip mandrel 355 includes one or more tooth-like protrusions, which serve as ramps for the one or more slips 330. The one or more slips 330 are disposed about the slip mandrel 355 adjacent a first end of the one or more of the tooth-like protrusions and are serrated to conform to the tooth-like protrusions. The one or more slips 330, when activated, engage the surrounding tubular 415, preventing both axial and radial movement of the latch assembly 101 relative to the surrounding tubular 415.

The block case 310 is disposed adjacent to the second set of bypass ports 301 and is threadably attached to the bypass sleeve 271. The block case 310 contacts a first portion of a slip retainer sleeve 340 and a setting sleeve 350. The sleeve 340 is at least partially disposed about a lower end of the one or more slips 330, preventing the slips 330 from separating or disengaging from the slip mandrel 355 during run-in of the latch assembly 101.

The block case 310 is in axial communication with the slip mandrel 355 by a spring 320. The spring 320 is housed in part by the block case 310 and an inner diameter of the setting sleeve 350. At least one first block 316 is attached to the block case 310 and at least one second block 317 is attached to the slip mandrel 355 by set pins 315. Each of the sleeves 340, 350 have at least one slot therethrough through which the blocks 316, 317 extend. The blocks 316 and 317 and the slots allow the sleeves 340 and 350 to shift axially while preventing radial movement relative to the tubular. The setting sleeve 350 transfers axial forces to the one or more slips 330 causing the slips 330 to move radially outward across the tooth-like perforations on the slip mandrel 355 toward the surrounding tubular 415 thereby frictionally or grippingly engaging the surrounding tubular 415.

FIG. 2C shows a partial cross section of a third portion of the latch assembly 101. The third portion of the latch assembly 101 includes the key assembly 400A, the slip retainer sleeve 340, at least one third block 376, a ratchet assembly 381, and a BHA connection 420. The slip retainer sleeve 340 is disposed about the slip mandrel 355, adjacent a second end of the slips 330 and has at least one slot therethrough. The third block 376 is attached to the slip mandrel 355 using set pins, extends through the slip retainer sleeve slot, and, with the slot, allows the slip retainer sleeve 340 to shift axially while remaining radially locked in position.

The ratchet assembly is disposed about the slip mandrel 355 adjacent the third block 376 to prevent the components described above from prematurely releasing once the components are actuated. The ratchet assembly includes a ring housing 380 disposed about a lock ring 382. The lock ring 382 is a cylindrical member annularly disposed between the slip mandrel 355 and the ring housing 380 and includes an inner surface having profiles disposed thereon to mate with profiles formed on the outer surface of the slip mandrel 355. The profiles formed on the lock ring 382 have a tapered leading edge allowing the lock ring 382 to move across the mating profiles formed on the slip mandrel 355 in one axial direction (toward the bottom of the page) while preventing movement in the other direction. The profiles formed on both the outer surface of the slip mandrel 355 and an inner surface of the lock ring 382 consist of geometry having one side which is sloped and one side which is perpendicular to the outer surface of the slip mandrel 355. The sloped surfaces of the mating profiles allow the lock ring 382 to move across the slip mandrel 355 in a single axial direction. The perpendicular sides of the mating profiles prevent movement in the opposite axial direction. Therefore, the split ring may move or "ratchet" in one axial direction, but not the opposite axial direction.

The ring housing 380 comprises a jagged inner surface to engage a mating jagged outer surface of the lock ring 382. The relationship between the jagged surfaces creates a gap there-between allowing the lock ring 382 to expand radially as the profiles formed thereon move across the mating profiles formed on the slip mandrel 355. A longitudinal cut within the lock ring 382 allows the lock ring 382 to expand radially and contract as it movably slides or ratchets in relation to the outer surface of the slip mandrel 355. The ring housing 380 is attached to the slip retainer sleeve 340 using a shear pin 385. The shear pin 385 can be broken by an upward force thereby allowing the slip retainer sleeve 340 to shift upwards.

The key assembly 400A includes one or more drag blocks 401 disposed about the slip mandrel 355. The one or more drag blocks 401 have angled shoulders formed therein and include two or more springs 405, which allow the drag blocks 401 to compress inward when inserted into the casing and to extend outward when the one or more drag blocks 401 abut a matching profile formed on an inner diameter of the tubular 415. A BHA (not shown) can be threadably attached to the slip mandrel 355 using the threaded connection 420 or any other means known in the art.

Figure 3C:
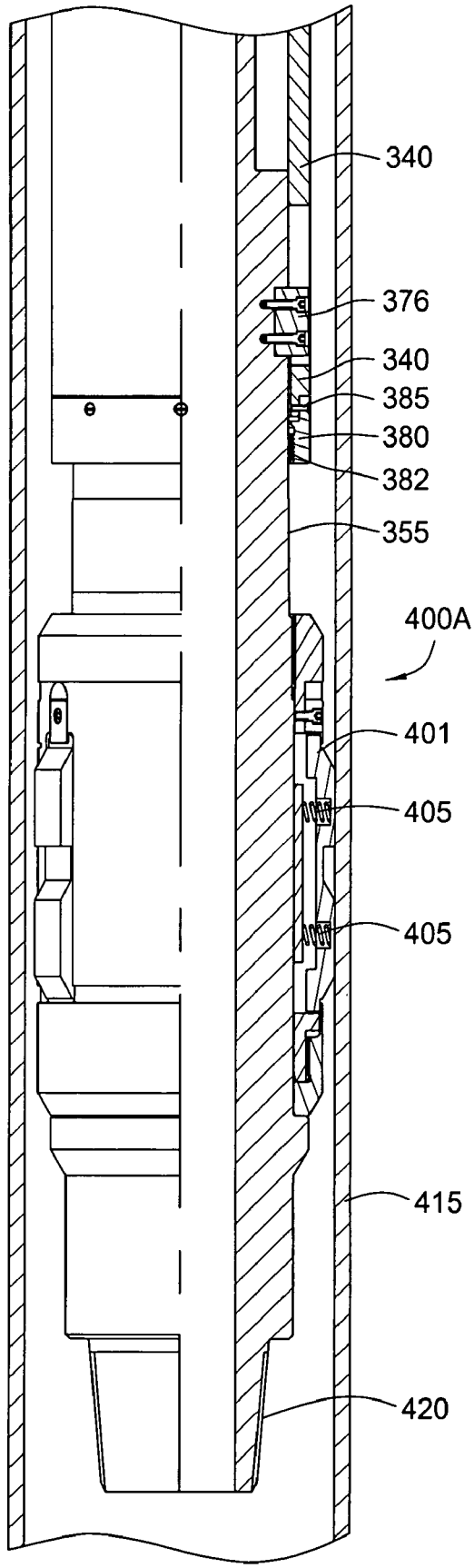
Figure 4C:
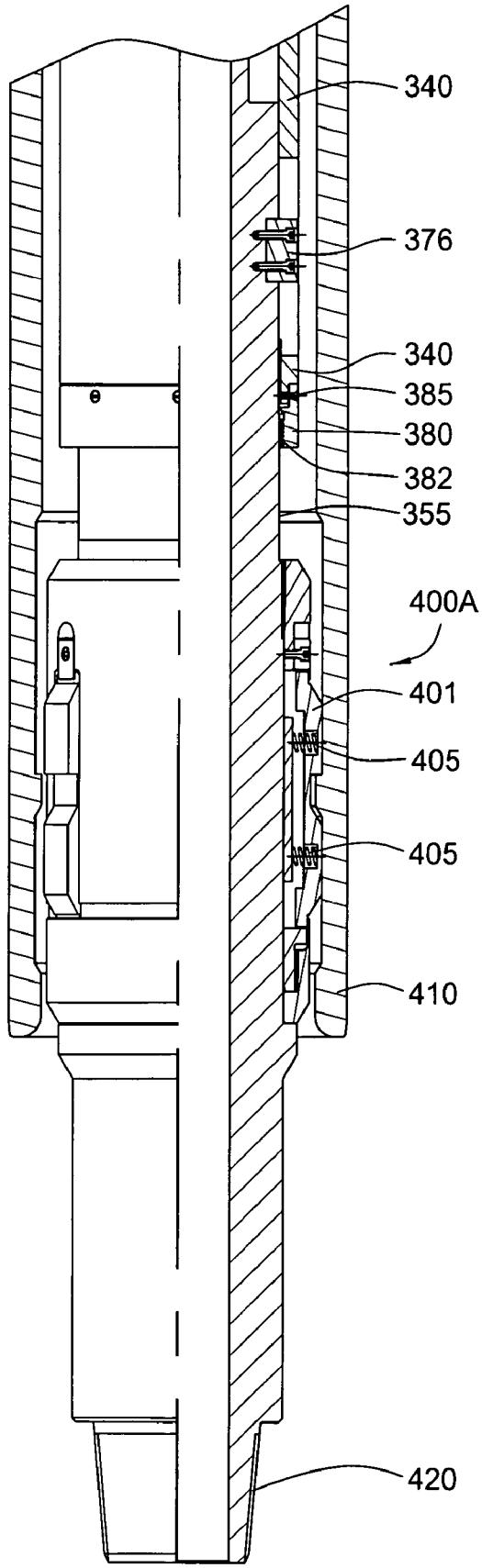
Figure 5C:
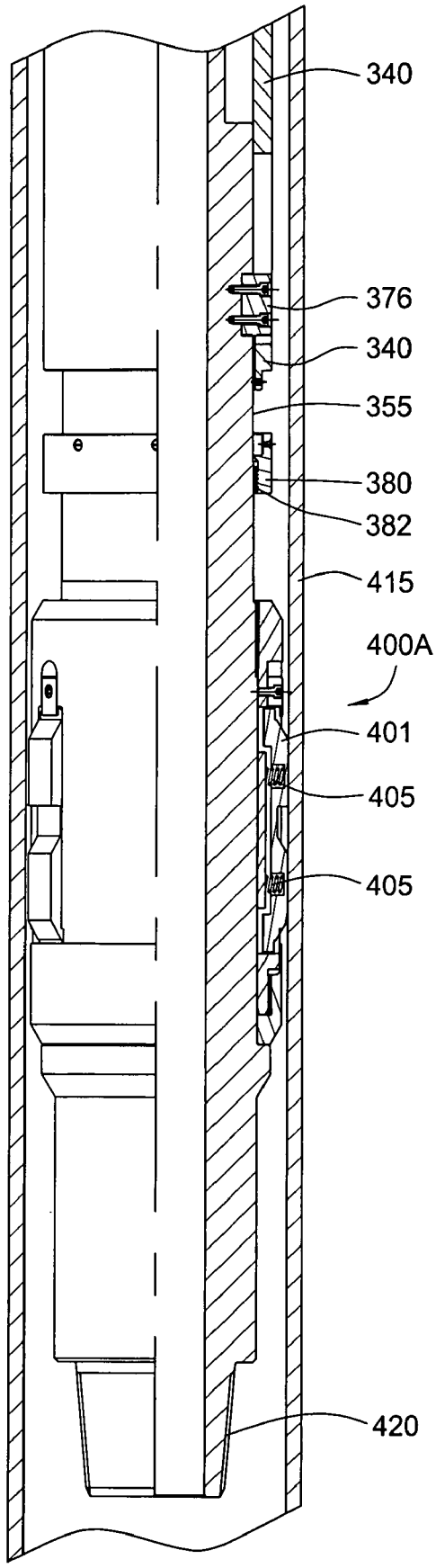

The operation of the latch assembly will be described in more detail below with reference to FIGS. 3A-C, 4A-C, and 5A-C. FIGS. 3A-C show the latch assembly 101 within a tubular 415 in a run-in position having an open pressure balanced bypass system. FIGS. 4A-C show the latch assembly 101 locked in position by the engaged key assembly 401 and the activated slips 330 against the tubular 415. FIGS. 5A-C show the latch assembly 101 having an activated or open pressure balanced bypass system being pulled out of the tubular 415.

Referring to FIGS. 3A-C, a bottom hole assembly (BHA) (not shown) is attached to the latch assembly 101, and the latch assembly 101 is supported above ground by a wire line, coiled tubing, drill pipe, or any other run in device well known in the art. The weight of the BHA (not shown) and the latch assembly 101 provide a downward force pulling the slip mandrel 355 downward while the bypass mandrel 201 is held stationary through communication with the well bore surface, as shown in FIG. 3B. Since the bypass mandrel 201 is held from the surface, the downward movement of the slip mandrel 355 causes the slips 330, which are engaged by the horizontal shoulders of the tooth-like protrusions on the slip mandrel 355, to shift downward as well. The slip mandrel 355 is also in axial communication with the block case 310 through the block 317, the sleeves 340, 350, and the block 316. The block 317 will move with the bypass mandrel 355, thereby transmitting the downward force to the sleeves 340, 350. The downward force is also transmitted to the sleeve 340 via abutment with the slips 330. The sleeves 340, 350 will then transfer the force to the block 316 which is coupled to the block case 310. Since the bypass sleeve 271 is threadably attached to the block case 310, the force moves the block case 310 downward thereby moving the bypass sleeve 271 below the second set of bypass ports 301. Through threaded connections, the force will be transmitted to the housing 210, which will move below the first set of bypass ports 205, thereby compressing the spring 270, until the housing rests on the shoulder 225. The housing 210 is positioned to allow fluid from the bypass mandrel 201 having entered through the second set of bypass ports 301 to exit the bypass mandrel 201 through the first set of bypass ports 205 into the annulus between the latch assembly 101 and the surrounding tubular 415.

Referring to FIG. 3C, the drag blocks 401 on the key assembly 400A are compressed inward by the surrounding tubular 415 thereby compressing the two or more springs 405. As a result, the latch assembly 101 is allowed to run into the tubular 415 until the latch assembly is set into place.

FIGS. 4A-C show the latch assembly 400A set in place within the tubular 415. Referring first to FIG. 4B, a collar or shoe 410 is threadably attached at one end of the tubular 415. The inner diameter of the collar or shoe 410 is engraved with a matching profile to engage the profile of the one or more drag blocks 401 of the key assembly 400A. Although a collar or shoe 410 is used in this embodiment to engage the key assembly 400A, the tubular 415 itself may be manufactured to include the key assembly 400A without the need for a collar or shoe 410. Once the extrusions 401 come into contact with the matching profile, the springs 405 extend outward causing the key assembly 400A to become locked into position on the shoe or collar 410 thereby locking the slip mandrel 355, which is threadably attached to the key assembly 400A, in position.

Referring to FIGS. 4A and 4B, once the slip mandrel 355 is locked into position, the weight of the BHA and the latch assembly 101 is removed from the bypass mandrel 201. The first spring 270, which is in axial communication with the cup mandrel 265, expands upward relative to the bypass mandrel 201 thereby also moving the cup mandrel 265, the cup assembly 250A, and the housing 210 upward. The cup mandrel 265 continues to move upward until the cup mandrel 265 contacts the shoulder protruding horizontally from the bypass mandrel 201 below the first set of bypass ports and the first spring 270 equilibrates. As the cup mandrel 265 moves upward, the fluid within the second plenum between the housing 210 and the cup mandrel 265 displaces through the second equalization ports 230. The housing 210 is positioned to close fluid access to the first set of bypass ports 205.

Still referring to FIGS. 4A and 4B, a setting force is exerted on the latch assembly 101 by pressuring up fluid in the annulus inside the tubular 415. As the fluid is pressured up, the packing ring 255 will expand and contact the tubular 415. The setting force will cause the housing 210, the cup assembly 250A, and the bypass mandrel 201 to move downward. Since the slip mandrel 355 is locked into position and the housing 210 is moving downward, the second spring 320 is compressed against a first shoulder of the slip mandrel 355 and the bypass sleeve 271. The compression of the second spring 320 allows the block case 310 to move downward relative to the slip mandrel 355 causing the slip retainer sleeve 340 and setting sleeve 350 to also move downward. The setting sleeve 350 contacts a first shoulder of the one or more slips 330 and pushes the slips angularly outward thereby frictionally engaging the surrounding tubular and preventing torsional or axial movement by the latch assembly 101. As the slips 330 are being set, the slip retainer sleeve 340 will ratchet down along the slip mandrel 355, thereby, locking the slips into place. The latch assembly 101 is now set in position.

Once the slips 330 are set, the fluid pressure may be further increased to break the rupture disk 110. Once the rupture disk 110 is broken, the fluid entering from above the latch assembly 101 enters the bypass mandrel 201 and continues through the slip mandrel 355 until reaching the BHA (not shown).

The setting force may optionally be provided by the run in device. In this scenario, the setting force would be exerted directly on the bypass mandrel 201 and transmitted to the cup mandrel 265 via abutment of the shoulder protruding horizontally from the bypass mandrel 201 below the first set of bypass ports 205 and the cup mandrel. Further, since the rupture disk 110 is not required, the fluid pressure may not have to ever be high enough to break it or to set the slips 330. Thus, the packer ring 255 may not set.

FIGS. 5A-C show partial cross section views of the latch assembly 101 being released from the wellbore. Upon release and retrieval of the latch assembly 101, a spear (not shown) may be lowered to engage the retrieval profile 130 on the bypass mandrel 201 and lifted toward the surface to move the latch assembly 101 upward. The upward force will be transmitted to the block case 310 via threaded connections leading to the bypass mandrel 201, then to the slip retainer sleeve 340 via abutment of block 316 with an end of the corresponding slot formed through the sleeves 340, 350. A sufficient upward force on the latch assembly 101 will break the shear pin 385 thereby freeing the slip retainer sleeve 340 from the ratchet assembly and causing the slip retainer sleeve 340 to push the slips 330 angularly inward towards the slip mandrel 355. Once the slips have been disengaged, the slip retainer sleeve will continue to move upward. The third block 376 will engage the end of the slip retainer sleeve slot thereby transmitting the upward force to the slip mandrel 355. The upward force will disengage the key assembly 400A from the profiled shoe 410. This again places the weight of the BHA and the latch assembly 101 on the bypass mandrel 201 thereby returning the latch assembly to the position described in FIGS. 3A-C, wherein both sets of bypass ports (205 and 301) are open for fluid flow, and activating the pressure balanced bypass system. The latch assembly 101 can now be lifted out of the tubular 415 without surging or swabbing the well. Once the latch assembly 101 is suspended above ground, operations may be stopped or a replacement BHA can be attached to the latch assembly 101 and again inserted into the tubular 415.

FIGS. 6A-F illustrate a partial cross section view of the latch assembly 501 according to another embodiment of the present invention in an un-set position, similar to that of FIGS. 2A-C. Since the latch assembly 501 in this embodiment operates in a similar manner to the latch assembly 101, only the differences will be discussed. Again, the bypass mandrel 201 has sections which are threadably connected, hereinafter, the bypass mandrel will be discussed as one piece. The retrieval profile 130 is formed integrally with the bypass mandrel 201. A potion of the bypass mandrel 201 extending above the cup assembly 250A has been substantially shortened by moving the bypass ports underneath the cup assembly 250A. By substantially eliminating any portion of the latch assembly 501 extending above the cup assembly 250A, the risk of obstructing the latch assembly with foreign matter or debris collecting above the cup assembly 250A is greatly reduced.

Instead of being disposed along the cup mandrel 265, the cup assembly 250A is disposed along the housing 210. The cup mandrel 265 has been omitted in this embodiment. A slotted cup protector 204 is threadably connected to the housing 210. Instead of the housing 210 extending into the first end void of the cup ring 251 and abutting the cup ring, the cup protector 204 extends into the first end void of the cup ring 251 and abuts the cup ring. The slots through the cup protector 204 provide fluid communication between the first end void of the cup ring 251 and an annular space formed between the bypass mandrel 201 and the cup protector 204. This prevents foreign matter or debris from collecting in the first end void of the cup ring 251.

Figure 6A:
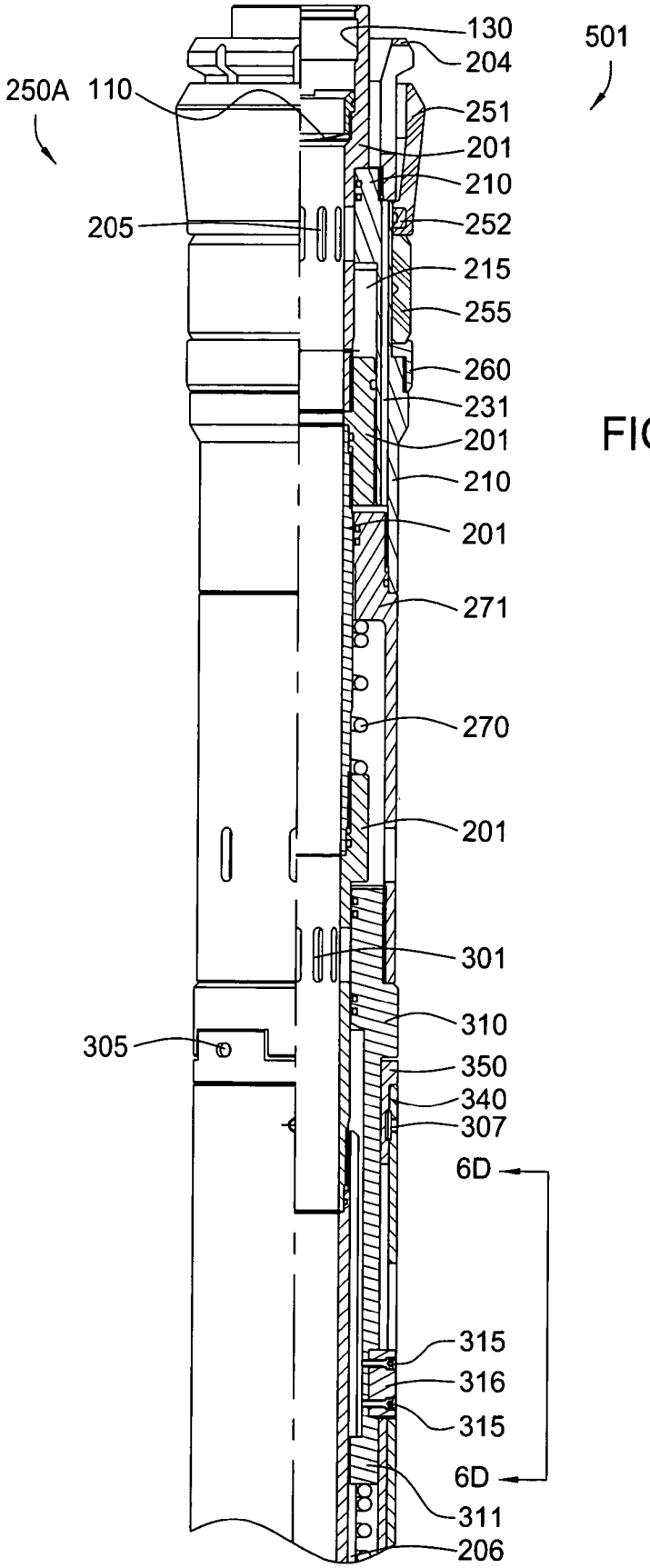
FIGS. 6A-C illustrate a partial cross section view of the latch assembly according to another embodiment of the present invention.

The latch assembly 501 may include one or more equilibration ports 231 formed axially through the housing 210, as shown in FIG. 6A. The equilibration ports 231 allow fluid pressure to equilibrate within the cup assembly 250A as described above with reference to the second equilibration ports 230 of the latch assembly 101. Also like the ports 230, the ports 231 displace fluid from the first plenum 215 to the annulus surrounding the latch assembly 301 as the housing 210 shifts axially. The threaded connection between the cup protector 204 and the housing 210 is slotted to allow fluid communication between the equalization port 231 and the annular space between the bypass mandrel 201 and the cup protector 204.

Since the cup mandrel 265 has been omitted, the bypass sleeve 271 is threadably attached to the housing 210. The bypass sleeve 271 also now abuts the first spring 270. The block case 310 is threadably connected to the bypass sleeve 271 on an inner side thereof, rather than the outside thereof. The block case 310 is now disposed adjacent to the second set of bypass ports 301 formed in the bypass mandrel 201, and moves axially across the bypass mandrel 201, in conjunction with the slot formed through the bypass sleeve 271, to open and close fluid access to the second set of bypass ports 301.

During downhole operations, foreign matter or debris may accumulate behind the extended slips 330 and prevent the slips 330 from retracting during retrieval of the latch assembly 101. To alleviate this problem, the latch assembly 501 may include one or more recessed grooves or pockets 360 formed in an outer surface of the slip mandrel 355 which operates in conjunction with an angled slot 314, as shown in FIGS. 6D and 6F.

To accommodate this feature, some of the structure and function of the bypass mandrel 201, block case 310, slip retainer sleeve 340, and setting sleeve 350 have been modified. The block case 310 is now connected to the setting sleeve 350 with a rotational connection, such as a notch and groove connection. The block case 310 and setting sleeve 350 are also connected with at least one shear pin 305 to provide axial restraint there-between. The sleeves 340, 350 are coupled to one another with a restraining ring 307 that is configured to restrain relative axial motion between the sleeves. The bypass mandrel 201 is coupled to the block case 310 with a spline and groove connection 206, 311. The bypass mandrel 201 is also coupled to the slip mandrel 355 with a spline and groove connection 206, 357. The spline and groove connections force relative rotation between the two respective members when one of the members is displaced relative to the other. Further, in this embodiment, the horizontal shoulders of the tooth-like protrusions of the slips 330 and the slip mandrel 350 do not abut in the un-set, closed position.

Figure 6D:
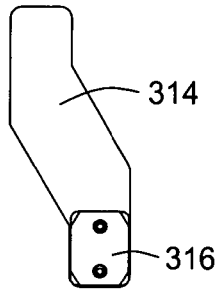
FIG. 6D shows an enlarged plan view of an angled rail or guide used to rotate the slip mandrel upon retrieval from the wellbore.
Figure 6B:
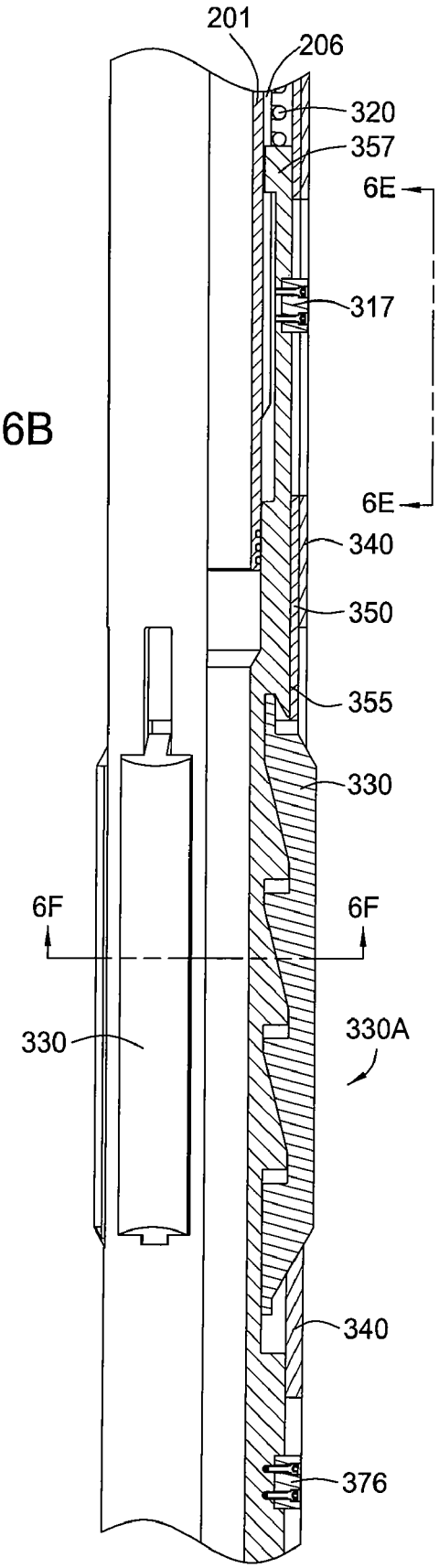

FIG. 6D shows a plan view of an angled slot or guide 314 used to rotate the slip mandrel upon retrieval from the wellbore. The angled slot 314 is formed through the slip retainer sleeve 340 and is disposed about the first block 316. Since the first block 316 is attached to the block case 310 by set pins 315, the movement of the first block 316 upward within the angled slot 314 causes the block case 310 to rotate axially relative to the slip retainer sleeve 340. The slip retainer sleeve 340 will be held from rotating by engagement of the slips 330 with the tubular. This upward movement will allow the slip mandrel 355 to rotate a distance defined by the inclination of the angled slot 314. This rotation will transmitted to the slip mandrel 355 by the spline and groove connections 206, 311; 206, 357.

Figure 6E:
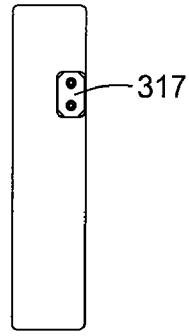
FIG. 6E shows an enlarged plan view of slots disposed through the slip retainer sleeve and setting sleeve.
Figure 6F:
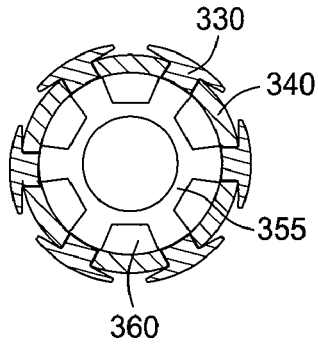
FIG. 6F illustrates a cross section view of the slip assembly along lines 6F-6F of FIG. 6B.

FIG. 6E shows a plan view of a slot disposed through the slip retainer sleeve 340 corresponding to block 316. The width of the slots has been increased to accommodate rotation of the slip mandrel 355, and thus the blocks 317, 376, relative to the sleeve 340.

FIG. 6F illustrates a cross section view of the slip assembly 330A along lines 6F-6F of FIG. 6B. An inner diameter of the sleeves 370 and the outer diameter of the slip mandrel 355 define the pockets 360. Accordingly, the pockets 360 are protected from the debris within the bore hole. The pockets 360 receive the slips 330 upon retrieval of the latch 501 when the slips 330 cannot retract toward the outer diameter of the slip mandrel 355. The pockets 360 are off-set from the slips 330, but the pockets 360 become aligned with the slips 330 when the slip mandrel 355 is rotated. The angled rail 314 forces rotational movement of the slip mandrel 355 relative to the slip retainer sleeve 340 and slips 330 to align the pockets 360 with the inner diameter of the slips 330. This alignment allows the slips 330 to retract into the pockets 360, thus disengaging the slips 330 from the surrounding tubular 415.

Figure 6C:
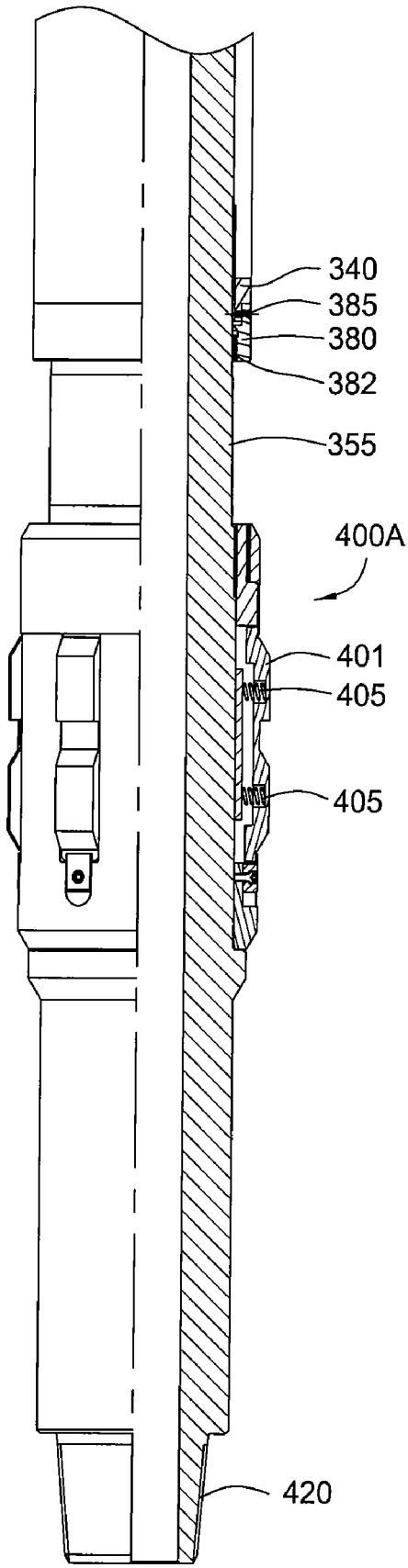

Operation of the latch assembly 501 is as follows. Referring to FIGS. 6A-C, a bottom hole assembly (BHA) (not shown) is attached to the latch assembly 501, and the latch assembly is supported above ground by a wire line, coiled tubing, drill pipe, or any other run in device well known in the art. The weight of the BHA (not shown) and the latch assembly 501 provide a downward force pulling the slip mandrel 355 downward while the bypass mandrel 201 is held stationary through communication with the well bore surface. Since the bypass mandrel 201 is held from the surface, the downward movement of the slip mandrel 355 causes the slips 330, which are engaged by a slot in the slip mandrel 355, to shift downward as well. The slips 330 transfer the downward force to the slip retainer sleeve 340 via abutment with the slip retainer sleeve at a lower end of the slips. The downward force will be transmitted to the setting sleeve 350 via the snap ring 307. The shear pin 305 will transfer the downward force from the setting sleeve 350 to the block case 310. Since the bypass sleeve 271 is threadably attached to the block case 310, the force moves the block case 310 downward thereby moving the bypass sleeve 271 below the second set of bypass ports 301. Through threaded connections, the force will be transmitted to the housing 210, which will move below the first set of bypass ports 205, thereby compressing the spring 270, until the housing rests on the shoulder 225. The setting of the latch assembly 400A, closing of the bypass ports 205, 301, and setting of the slips 330 are similar to that of the latch assembly 101 and will not be repeated.

Upon release and retrieval of the latch assembly 501, a spear (not shown) may be lowered to engage the retrieval profile 130 on the bypass mandrel 201 and lifted toward the surface to move the latch assembly 101 upward. The upward force will be transmitted to the block case 310 via threaded connections between the bypass mandrel 201 and the block case 310, then to the setting sleeve 350 via the shear pin 305. The upward force will be transmitted from the setting sleeve 350 to the slip retainer sleeve 340 via the snap ring 307. A sufficient upward force on the latch assembly 501 will break the shear pin 385 thereby freeing the slip retainer sleeve 340 from the ratchet assembly and causing the slip retainer sleeve to push the slips 330 angularly inward towards the slip mandrel 355 if the slips are not obstructed by wellbore debris. The rest of the removal process is similar to that of the embodiment described above.

If the slips 330 are obstructed by wellbore debris, the upward force may be increased to break shear pin 305. This will free the setting sleeve 350 from the block case 310. The upward force will move the block case 310 relative to the slip retainer sleeve 340. The block 316 will move along the guide 314 forcing rotation of the block case 310. This rotation will be transmitted to the slip mandrel 355 by the spline and groove connections 206, 311; 206, 357. Blocks 317, 376 are free to rotate with the slip mandrel 355 due to the enlarged corresponding slots. The rotation of the slip mandrel 355 will align the pockets 360 with the slips 330, thereby allowing the slip retainer sleeve 340 to disengage the slips 330. The removal of the latch assembly 501 may then be completed.

In another aspect, the latch assemblies 101, 501 may further include an API tool joint (not shown) disposed about the bypass mandrel 201. The API tool joint (not shown) is well known in the art and can be disposed adjacent the retrieval profile 130 and rupture disk 110, along the bypass mandrel 201. The API tool joint can receive a run in device. Unlike the retrieval profile 130, the API tool joint torsionally locks the latch assembly 501 to the run-in tool thereby allowing the run-in tool to rotate the bypass mandrel 201.

Figure 7:
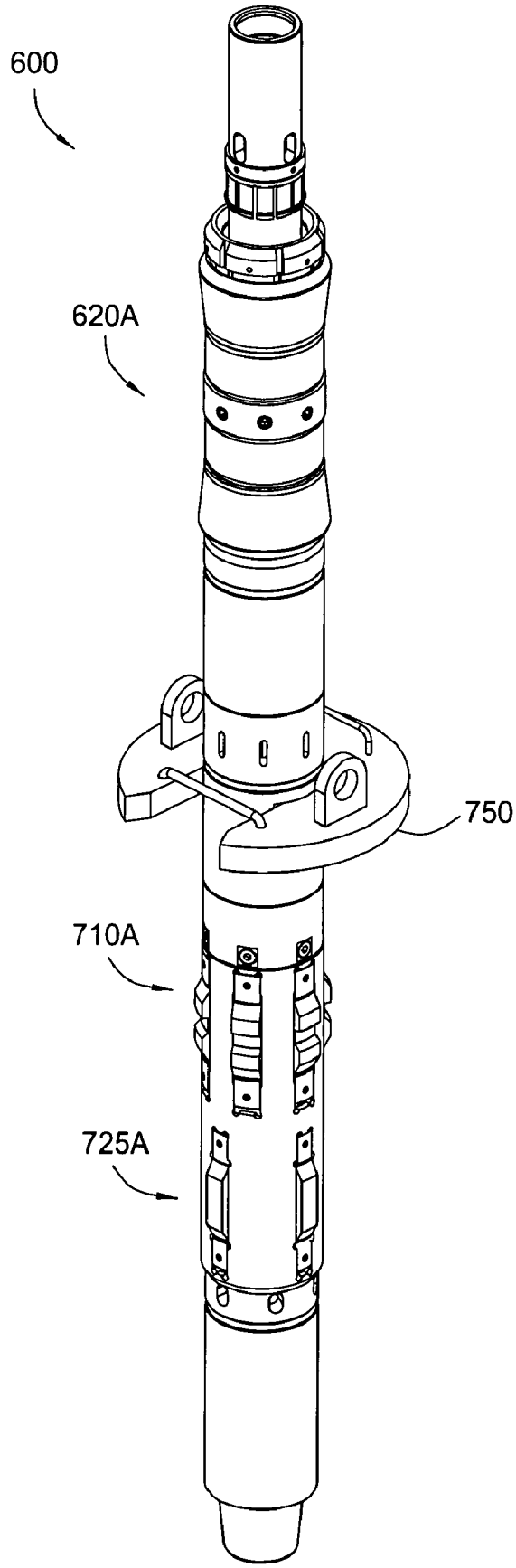
FIG. 7 shows a schematic side view of a latch assembly according to another embodiment of the invention described herein in an open position.

FIG. 7 shows a schematic side view of a latch assembly 600 according to another embodiment of the invention described herein in an open position. The latch assembly 600 is actuatable between open and closed positions. The latch assembly 600 includes a cup assembly 620A, a safety collar 750, an axial drag block assembly 710A, and a torsional drag block assembly 725A. The latch assembly 600 is in communication with the surface of a wellbore at a first end thereof, and the BHA (not shown) is attachable to the latch assembly 101 at a second end thereof.

Figure 8A:
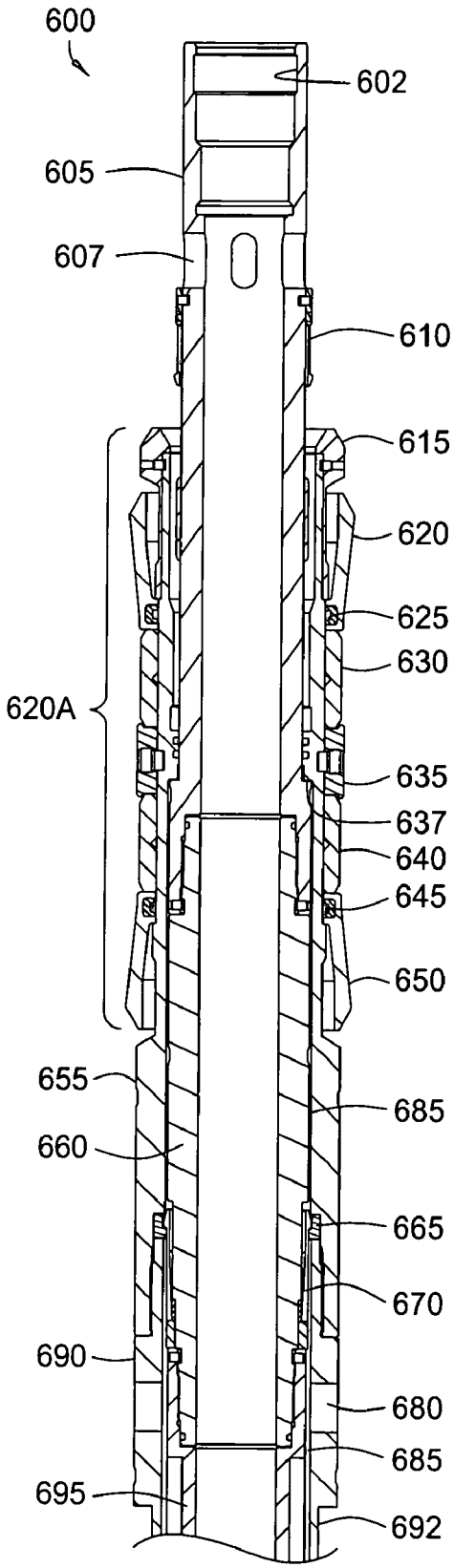
FIGS. 8A-B illustrate a cross section view of the latch assembly shown in FIG. 7.
Figure 8B:
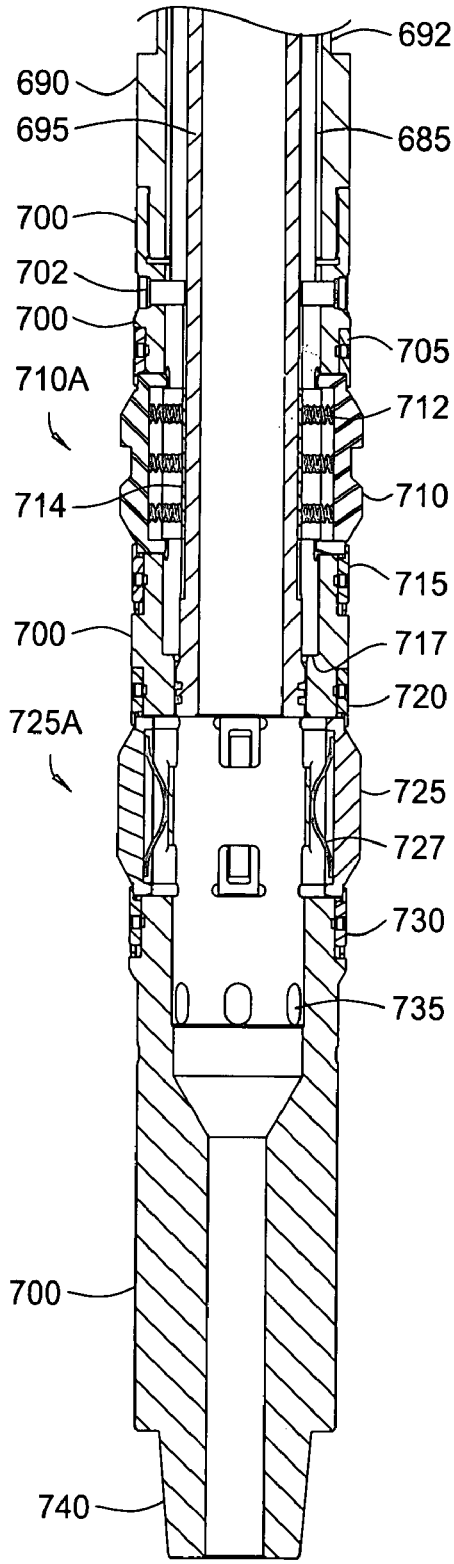
Figure 8C:
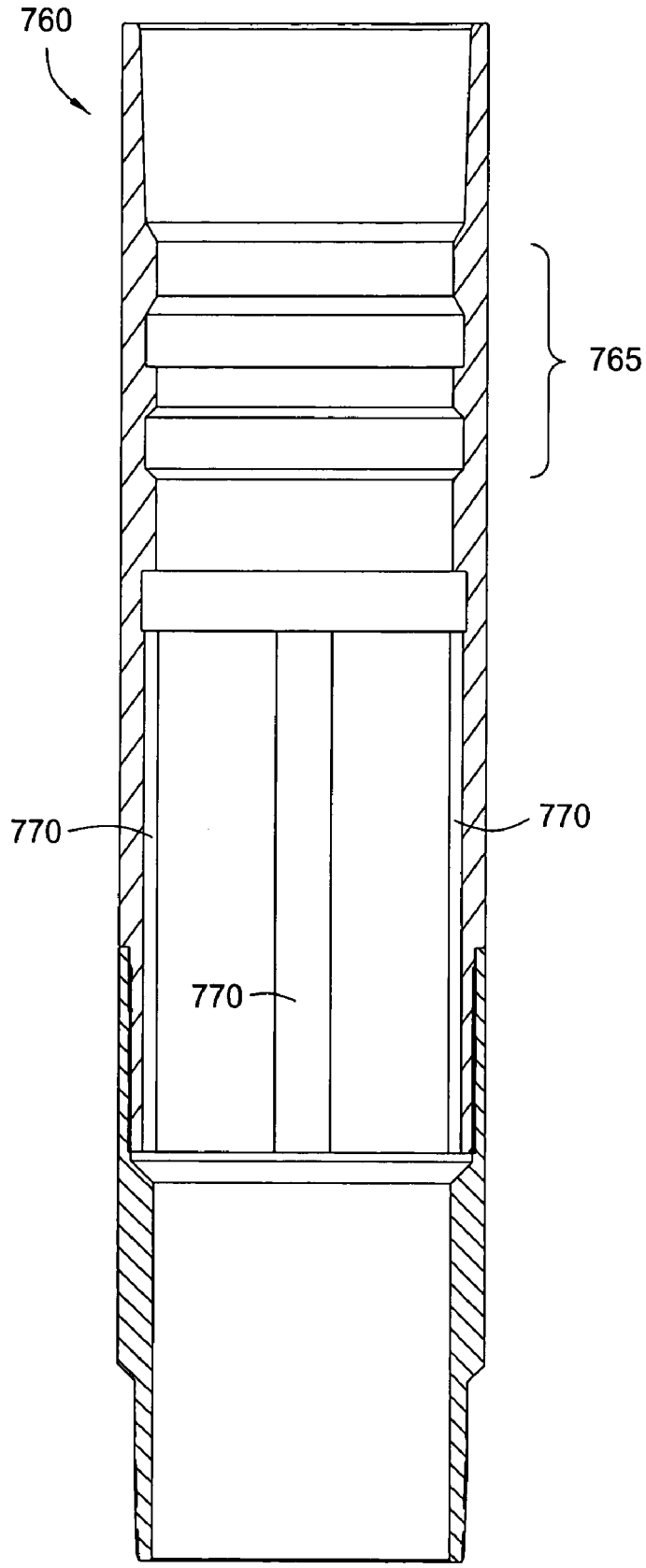
FIG. 8C shows a cross section view of a landing collar for use with the latch assembly of FIG. 7.
Figure 9A:
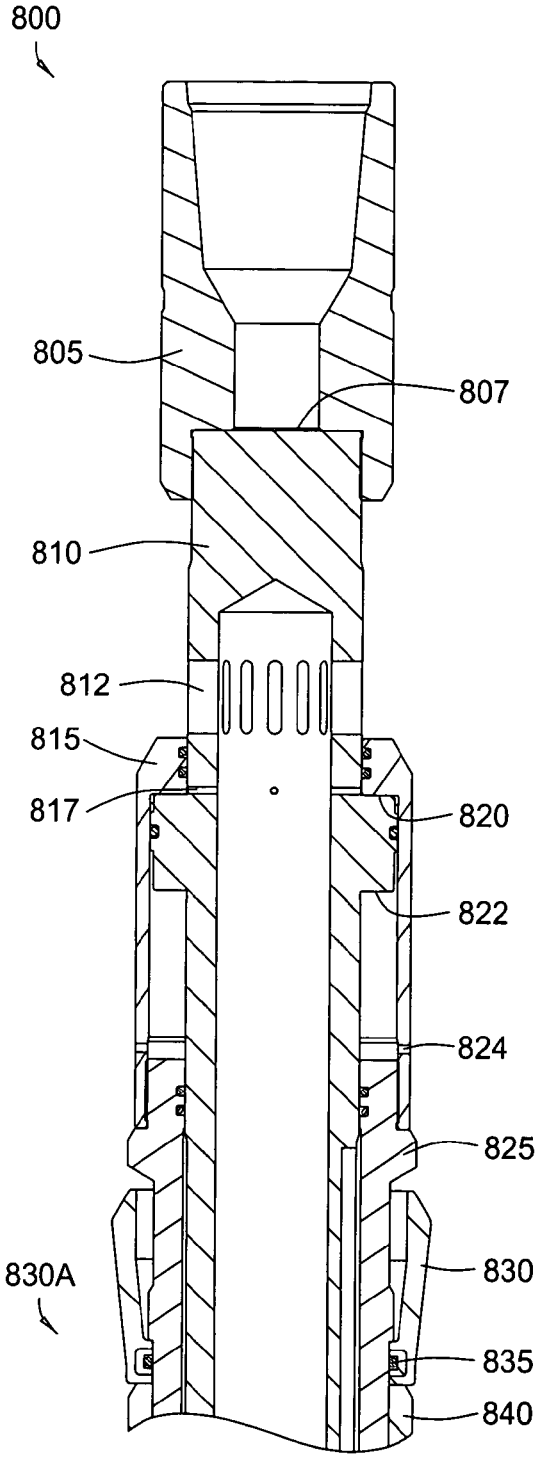
FIGS. 9A-B illustrate a cross section view of a setting tool for use with the latch assembly of FIG. 7, in an open position.
Figure 9B:
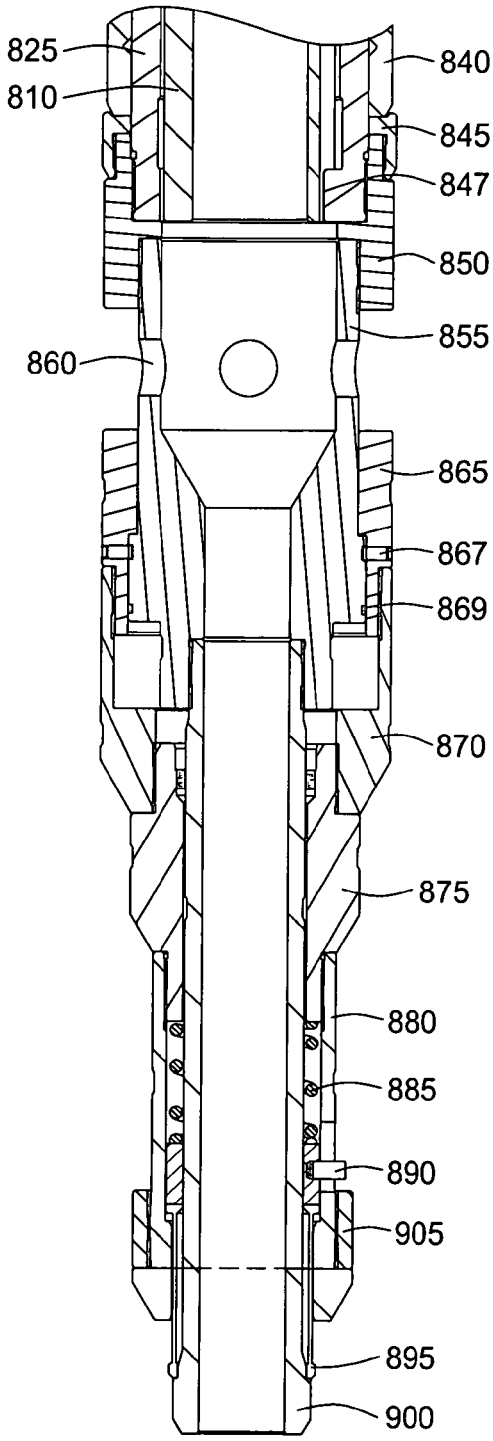

FIGS. 8A-B illustrate a cross section view of the latch assembly 600 shown in FIG. 7, also in an open position. FIG. 8C shows a cross section view of a landing collar 760 for use with the latch assembly 600. FIGS. 9A-B illustrate a cross section view of a setting tool 800 for use with latch assembly 600, in an open position. The latch assembly 600 and the setting tool 800 share some common features with the latch assemblies 101, 501. Since the common features have been discussed above in detail, the discussion will not be repeated.

The latch assembly 600 includes a bypass mandrel 605 and the cup assembly 620A. Threadably attached to the bypass mandrel 201 is a collet mandrel 660. Also threadably attached to the collet mandrel 660 is a locking mandrel 695. The bypass mandrel 605 and a drag block body 700 (see FIG. 8B) each include a set of bypass ports 607, 735 formed therethrough. The two or more sets of bypass ports 607, 735 form a pressure balanced bypass system, which allows the assembly 600 to be run in a wellbore and pulled out of a wellbore without surging or swabbing the well. The bypass ports 607, when actuated in the closed position, provide a fluid circulation path while drilling to prevent debris from settling between a cup mandrel 655 and the bypass mandrel 605.

Formed on an inner side of the bypass mandrel 605 is a retrieval profile 602. The retrieval profile 602 is similar to that of retrieval profile 130. Disposed along the bypass mandrel 605 is a first collet 610. The first collet 610 is coupled to the mandrel 605 by set screws. The first collet 610 has one or more cantilevered fingers. The fingers of the first collet 610 will engage a shoulder of the cup mandrel 655 when the latch assembly 600 is actuated to the closed position (see FIGS. 11A-C), thereby latching the cup mandrel 655 to the bypass mandrel 605. The cup mandrel 655 abuts a shoulder 637 of the bypass mandrel 605 in the open position.

The cup assembly 620A has two sub-assemblies, respective cup rings 620, 650 of the sub-assemblies each facing opposite directions. Each sub-assembly is similar to that of the cup assembly 250A. The sub-assembly facing downward has been added to resist backfill as a new casing joint is added to the casing string 780 during drilling. Disposed along the cup mandrel 655 is a slotted (see FIG. 7) cup protector 615. The cup protector is similar to cup protector 204. Disposed along the cup protector 615 and the cup mandrel 655 is a first cup ring 620. The first cup ring 620 has a first o-ring retainer 625. The cup protector 615 abuts an end of the first cup ring 620 to aid in retaining the ring 620 in place. The cup protector 615 is coupled to the cup mandrel 655 by set screws. Further disposed along the cup mandrel 655 is a first packer ring 630. The first packer ring 630 abuts the cup ring 620 on a first side and a gage ring 635 on a second side. The gage ring 635 is coupled to the cup mandrel 655 by a set pin. Further disposed along the cup mandrel 655 and abutting the gage ring 635 is a second packer ring 640. Abutting the second packer ring 640 and disposed along the cup mandrel 655 is a second cup ring 650. The second cup ring 650 has a second o-ring retainer 625. The cup mandrel 655 abuts an end of the second cup ring 650 to aid in retaining the ring 650 in place.

Threadably attached to the cup mandrel 655 is a case 690. Abutting the cup mandrel 655 and a threaded end of the case 690 that engages the cup mandrel is a collet retainer 665. A second collet 670 is disposed along the collet mandrel 660 and coupled thereto with set screws. In the open position as shown, the collet retainer 665 is engaged with the second collet 670, thereby latching the collet mandrel 660 to the cup mandrel 655. The second collet 670 and collet retainer 665 are configured so that a greater force is required to disengage the second collet from the collet retainer than to engage the second collet with the collet retainer. The case 690 has one or more equalization ports 680 therethrough connected to at least one equalization passage 685. The equalization passage 685 is formed between the mandrels 605, 660, 695 and the cup mandrel 655, case 690, and drag block body 700. The equalization ports 680 and passages 685 displace fluid from the latch assembly 600 as the mandrels 605, 660, 695 shift axially relative to the rest of the latch assembly.

Formed on the case 690 is a slot 692. The slot 692 is configured to mate with the safety collar 750 (see FIG. 7). The safety collar 750 has two handles for connection to handling equipment (not shown) and two safety bars. The safety collar 750 provides a rigid support for the latch assembly 600 for handling at a well platform (not shown). The latch assembly 600 could also be handled by coupling a spear (not shown) to the bypass mandrel 605 using the retrieval profile 602. This method, however, is not failsafe as is using the safety collar 750.

Threadably attached to the case 690 is the drag block body 700. The drag block body 700 is coupled to the locking mandrel 695 by one or more locking pins 702. The locking pins 702 extend into at least one slot partially disposed through the locking mandrel 695. The pin-slot connections will allow partial relative axial movement between the body 700 and the mandrel 695 while restraining relative rotation there-between. The drag block body forms a shoulder 717 for seating an end of the locking mandrel 695, when the locking mandrel is actuated.

Disposed along the drag block body 700 and coupled thereto with set screws are one or more first axial drag block keepers 705 and one or more second axial drag block keepers 715. Abutting each first keeper 705 and second keeper 715 is an axial drag block 710. One or more sleds 714 are disposed along the locking mandrel 695. Each sled is disposed in a corresponding slot formed in the locking mandrel. Each axial drag block 710 is coupled to each sled 714 with a set of springs 712. The slots allow partial relative axial movement between the locking mandrel 695 and the sleds 714, while preventing rotational movement there-between. Each axial drag block 710 has one or more shoulders formed therein. The shoulders are configured to restrain each axial drag block 710 from downward movement relative to the landing collar 760 (see FIG. 8C). The springs 712 allow the drag blocks 710 to compress inward when inserted into the casing and to extend outward when the drag blocks 710 abut a matching profile 765 formed on an inner diameter of the landing collar 760. When the latch assembly 600 is actuated to the closed position (see FIGS. 11A-C), the locking mandrel 695 will provide a backstop for each axial drag block 710, thereby preventing the drag blocks from compressing inward. This will restrain the axial drag blocks 710 from upward movement relative to the landing collar 760.

Further disposed along the drag block body 700 and coupled thereto with set screws are one or more first torsional drag block keepers 720 and one or more second torsional drag block keepers 730. Abutting each first keeper 720 and second keeper 730 is a torsional drag block 725. Each torsional drag block 725 is coupled to the drag block body 700 with a spring 727. The springs 727 allow the drag blocks 725 to compress inward when inserted into the casing and to extend outward when the drag blocks 725 align with axial slots 770 formed on an inner diameter of a landing collar 760 (see FIG. 8C). A BHA (not shown) may be threadably attached to the body 700 using a threaded end 740 or any other means known in the art.

FIG. 9 illustrates a cross section view of a setting tool 800 in an open position. The setting tool 800 includes cup assembly 830A, which is similar to cup assembly 250A. The setting tool 800 also includes a drill pipe sub 805 configured to be threadably attached to a string of drill pipe. Alternatively, a retrieval assembly, similar to retrieval assembly 130A may be used instead of drill pipe sub 805. Threadably attached to the drill pipe sub 805 is a bypass mandrel 810. The bypass mandrel 810 forms a solid plug portion 807 at the threaded connection with the drill pipe sub 805. The plug portion 807 is similar in functionality to the rupture disk 110 (before the disk is broken). A solid plug 807 may be used instead of a rupture disk since the setting tool 800 is removed prior to commencement of drilling. Thus a flow bore is not required through the setting tool 800. The bypass mandrel 810 and a center mandrel 855 include two or more sets of bypass ports 812, 860 formed therethrough. The two or more sets of bypass ports 812, 860 form a pressure balanced bypass system, which allows the setting tool 800 to be run in a wellbore and pulled out of a wellbore without surging or swabbing the well.

A housing 815 is disposed adjacent the first set of bypass ports 812 formed within the bypass mandrel 810. The housing 815 is threadably engaged with a cup mandrel 825, allowing the housing 815 to transfer axial forces to and from the cup mandrel 825. The housing 815 also acts to open and close fluid access to the first set of bypass ports 812 by shifting axially across the bypass mandrel 810. As shown, in the open position, the housing abuts a first shoulder 820 of the bypass mandrel 810. When the setting tool 800 is actuated to the closed position (see FIGS. 11A-C), the cup mandrel 825 will abut a second shoulder 822 of the bypass mandrel 810. One or more first equalization ports 817 are formed through the bypass mandrel 810, similar to first equalization ports 220. One or more second equalization ports 824 are formed through the housing 815, similar to second equalization ports 230.

Adjacent the threaded connection between the housing 815 and the cup mandrel 825, the cup mandrel forms a shoulder. The shoulder serves as a cup protector. Disposed along the cup mandrel 825 is a cup ring 830. The cup ring 830 has a first o-ring retainer 835. The cup mandrel 825 abuts an end of the cup ring 830 to aid in retaining the ring 830 in place. Further disposed along the cup mandrel 825 is a packer ring 840. The packer ring 840 abuts the cup ring 830 on a first side and a gage ring 845 on a second side. The gage ring 845 is threadably attached to a gage ring retainer 850. The cup mandrel 825 is also threadably attached to the gage ring holder 850.

Formed at an end of the cup mandrel 825 is at least one block end 847. The block end extends into at least one axial slot formed in the bypass mandrel 810. The block-slot connection allows limited relative axial movement between the bypass mandrel 810 and the cup mandrel 825, while restraining rotational movement there-between.

The center mandrel 855 is threadably connected to the gage ring holder 850. Disposed along and abutting the center mandrel 855 is a shear pin case 865. The shear pin case 865 is coupled to the center mandrel 855 with one or more shear screws 867. The shear screws 867 retain the case 865 to the center mandrel 855 until a sufficient downward force is applied to the center mandrel 855, thereby breaking the shear screw 867. The center mandrel 855 is then free to move downward relative to the shear pin case 865. A snap ring 869 is disposed between the center mandrel 855 and the shear pin case 865. The snap ring 869 will engage the shear pin case 865 when the shear screws 867 are broken and the center mandrel 855 moves downward relative to the shear pin case, thereby acting as a downward stop for the shear pin case.

Also threadably connected to the center mandrel 855 is a spear mandrel 900. Threadably attached to the shear pin case 865 is a first case 870. Threadably attached to the first case 870 is a locking case 875. An equalization passage is formed between the spear mandrel 900 and the locking case 875 to provide fluid relief when the shear pins 867 are broken and the center mandrel moves downward relative to the shear pin case 865. Optionally, the first case 870 and the locking case 875 may be one integral part. Abutting the locking case on a first end and a collet 895 on the second end is a spring 885. Threadably attached to the locking case 875 is a second case 880. Disposed through the second case 880 is at least one slot. At least one pin 890 extends from the collet 895 through the slot of the second case 880. The pin-slot connection allows limited relative axial movement between the collet 895 and the second case 880, while restraining rotational movement there-between. The collet 895 is disposed along the spear mandrel 900. Fingers of the collet 895 are restrained from compressing by abutment with a tapered shoulder formed along the spear mandrel 900. The spring 885 and the slot disposed through the second case 880 allow axial movement of the collet 895 relative to the spear mandrel 900 so that the fingers of the collet may compress. Further, when the shear pin 867 is broken and the center mandrel 855 is moved downward relative to the locking mandrel 865, the spear mandrel 900 will also move downward relative to the collet 895, thereby allowing the fingers of the collet to compress. A releasing nut 905 is disposed along the spear mandrel 900 and threadably attached thereto. The spear mandrel 900 and collet 895 are engageable with the retrieval profile 602 of the latch assembly 600 (see FIGS. 10B, 11B).

FIGS. 10A-C show the latch assembly 600 coupled to the setting tool 800 and a BHA (not shown) having been run into a string of casing 780 using a known run in device (not shown), wherein the latch assembly and setting tool are in an open position. Operation of the latch assembly 600 and setting tool 800 are as follows. At the surface of the wellbore (not shown), the latch assembly 600 has been coupled to the setting tool 800. The retrieval profile 602 has received the spear mandrel 900. The fingers of the collet 895 have engaged the profile 602 by compression of the spring 885 and movement of the fingers along the tapered shoulder of the spear mandrel 900. During run in, the latch assembly 600 is restrained in the open position by the second collet 670 and the setting tool 800 is restrained in the open position by the weight of the BHA, latch assembly, and a portion of the setting tool. Disposed within the casing 780 is the landing collar 760. The latch assembly 600, with the BHA attached to the threaded end 740 of the latch assembly, and the setting tool 800 are run into the casing until the axial drag blocks 710 engage the profile 765. The casing 780 may then be rotated relative to the latch assembly 600 until the torsional drag blocks 725 engage the profile 770. Alternatively, the latch assembly 600 may be rotated relative to the casing 780 using a mud motor in the BHA, if the BHA is so configured.

FIGS. 11A-C show the latch assembly 600 coupled to the setting tool 800 and the BHA (not shown) disposed in the casing 780, wherein the latch assembly is in a closed position. The setting tool 800 is fully engaged with the latch assembly when a shoulder of the slotted mandrel 880 abuts the bypass mandrel 605. The weight of the setting tool 800 will then bear upon the latch assembly 600. This will cause the bypass mandrel 810 to move downward relative to the housing 815 and center mandrel 855 until the shoulder 822 abuts the cup mandrel 825, thereby closing the bypass ports 812, 860.

A downward setting force is then applied to the setting tool 800 by either the run in device or fluid pressure. The setting force will be transferred from the setting tool 800 to the latch assembly 600. This force will disengage the second collet 670 and cause the setting tool 800, the bypass mandrel 605, the collet mandrel 660, and the locking mandrel 695 to move downward relative to the rest of the latch assembly 600. The setting tool 800 and the mandrels 605, 660, 695 will move downward until the end of the locking mandrel 695 abuts the shoulder 717 of the drag block body 700. During this movement, the fingers of the first collet 610 will engage the shoulder of the cup mandrel 655, thereby retaining the latch assembly 600 in the closed position. In this position, the locking mandrel 695 has closed bypass ports 735 and locked the axial drag blocks 710 into place. Bypass ports 607 are in fluid communication with a channel formed in the cup mandrel 655 to provide fluid circulation.

The setting tool 800 may now be removed from the latch assembly 600. The setting force will be increased to break the shear pins 867. The center mandrel 855 and spear mandrel 900 are now free to move downward relative to the shear pin case 865 and the collet 895 until the center mandrel abuts the first case 870, thereby freeing the fingers of the collet from the tapered shoulder of the spear mandrel 900. As the center mandrel is moving, the snap ring 869 will engage the shear pin case 865. An upward force may now be applied to the setting tool 800 to free the setting tool from the latch assembly 600. This force will cause the bypass mandrel 810 to move upward relative to the rest of the setting tool 800 until the shoulder 820 abuts the housing 815. This movement will open the bypass ports 812, 860. The force will be transferred from the housing 815 to the center mandrel 855 via threaded connections. The force will be transferred from the center mandrel 855 to the spear mandrel 900 via a threaded connection and to the shear pin case 865 via the snap ring 869. The force will be transferred from the shear pin case 865 to the second case 880 via threaded connections. The force will be transferred from the second case 880 to the collet 895 via abutment of the pin 890 with an end of the slot through the second case 880. The force will cause the collet 895 to disengage from the retrieval profile 602. The setting tool 800 may then be removed from the wellbore. Drilling operations may then be commenced.

Optionally, before commencing drilling, it may be verified that the locking mandrel 695 has properly set. Fluid may be pumped into the casing 780. If the locking mandrel 695 has not properly set, the bypass ports 735 will be open. This would be indicated at the surface by a relatively low pressure drop across the latch assembly 600. If the locking mandrel 695 has properly set, the bypass ports 735 will be closed, resulting in a relatively higher pressure drop across the latch assembly 600 as fluid flow will be forced through the BHA.

When it is desired to remove the latch assembly 600 from the wellbore, a run in device with a spear (not shown) may be lowered to engage the retrieval profile 601. An upward releasing force may then be applied to the bypass mandrel 605. The upward force will be transferred to the collet mandrel 660 and the locking mandrel 695 via threaded connections. The force will cause the fingers of the first collet 610 to disengage from the cup mandrel 655, thereby allowing the mandrels 605, 660, 695 to move upward relative to the rest of the latch assembly 600. The mandrels 605, 660, 695 will move upward until the shoulder 637 of the bypass mandrel 605 engages the cup mandrel 655.

During this movement, the second collet 670 will engage the collet retainer 665 and the locking mandrel 695 will move past the axial drag blocks 710, thereby allowing the drag blocks 710 to retract. This movement will also open the bypass ports 735. The axial drag blocks 710 may then disengage the profile 765 by compressing inward. The latch assembly 600 will then move upward relative to the landing collar 760 until the torsional drag blocks disengage from the profile 770 by compressing inward. The latch assembly 600 and BHA are now free from the landing collar 760 and may be removed from the wellbore.

In an alternative aspect of latch assembly 600, the axial 710 and torsional 725 drag blocks may be replaced by one or more dual function blocks. In another alternative aspect, the drag block body 700 may be separated into an axial drag block body and a torsional drag block body. In yet another alternative aspect, the first 610 and second 670 collets may be replaced by shear pins.

Figure 12A:
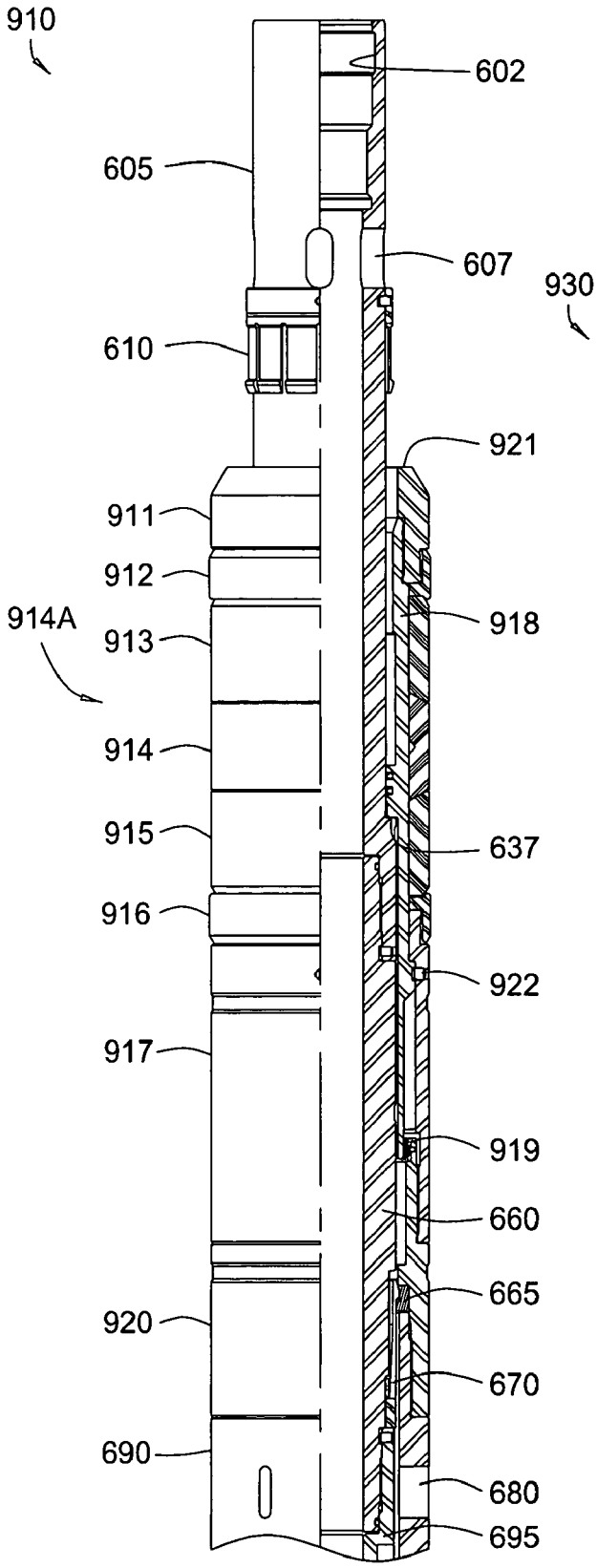
FIG. 12A shows a partial cross section view of a portion of a latch assembly according to yet another alternative aspect of latch assembly of FIGS. 8A-B, in an open position.
Figure 12B:
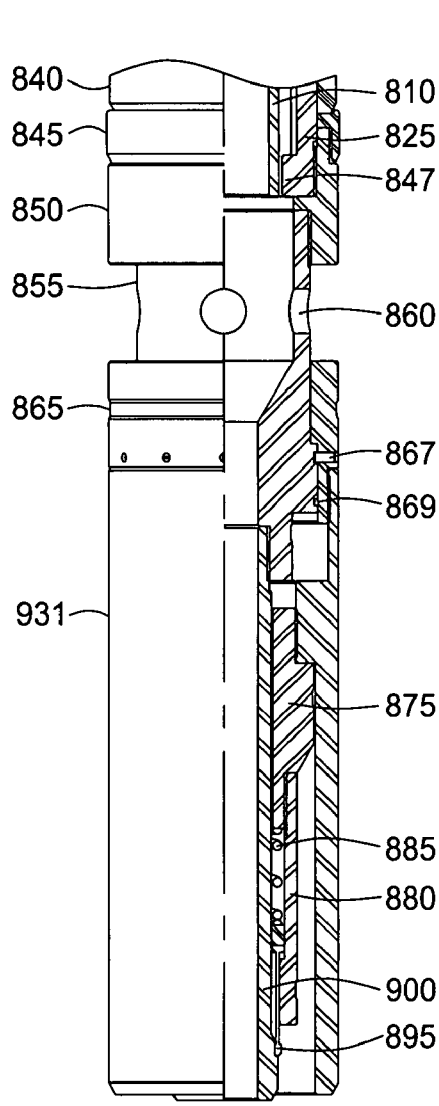
FIG. 12B shows a partial cross section view of a portion of a setting tool according an alternative aspect of the setting tool of FIGS. 9A-B.

FIG. 12A shows a partial cross section view of a portion of latch assembly 910 according to yet another alternative aspect of latch assembly 600, in an open position. FIG. 12B shows a partial cross section view of a portion of a setting tool 930 according an alternative aspect of the setting tool 800. The remaining portions (not shown) of latch assembly 910 and setting tool 930 are identical to those of latch assembly 600 and setting tool 800. Only the differences between the assemblies 600, 910 and tools 800, 930 will be discussed. The primary difference between the assemblies 600, 910 and tools 800, 930 is the substitution of a mechanically set and retained packer assembly 914A for the cup assembly 620A.

Referring to FIG. 12A, to effectuate this substitution, the slotted cup protector 615 has been replaced by an actuator 911. The actuator 911 has a shoulder 921 for abutting a corresponding shoulder of a sleeve 931 of setting tool 930. Threadably attached to the actuator 911 is a first gage ring 912. The first gage ring 912 abuts an end of a packing element. Preferably, the packing element has three portions: two relatively hard portions 913, 915 and a relatively soft portion 914. The first 913 and second 915 hard portions transfer a setting force from gage rings 912, 916 to the soft portion 914, thereby expanding the soft portion to contact a tubular (not shown). Abutting an end of the second hard portion 915 is the second gage ring 916.

The gage rings 912, 916 and the packing element 913-915 are disposed along a packer mandrel 918. The packer mandrel 918 is similar to the cup mandrel 655. The actuator 911 and the packer mandrel 918 are threadably connected. The second gage ring 916 is threadably attached to a gage case 917. The gage case 917 is also threadably attached to a sleeve 920 and abuts the packer mandrel 918 in this position. The gage case is coupled to the packer mandrel with a shear screw 922 to prevent premature setting of the packing element 913-915. The packer mandrel 918 and the sleeve 920 are coupled together by a ratchet assembly 919. The ratchet assembly 919 is similar to the ratchet assembly of the latch assembly 101, thereby retaining the soft portion 914 of the packer element in an expanded position until a shear pin of the ratchet assembly is broken. The sleeve 920 and the case 690 are threadably attached together. The collet retainer 665 is disposed between the sleeve 920 and the case 690.

Referring to FIG. 12B, the sleeve 931 has been substituted for the first case 870. The sleeve 931 is threadably attached to the shear pin case 865 and the locking case 875. The sleeve 931 extends to about an end of the setting tool 930 that is configured to mate with the profile 602 of the latch assembly 910 and has a shoulder at the end thereof for mating with the corresponding shoulder 921 of the actuator 911. The at least one pin 890 and corresponding slot through the second case 880 have been omitted.

Operation of the latch assembly 910 and setting tool 930 are as follows. The run in steps for latch assembly 910 and setting tool 930 are similar to those of latch assembly 600 and setting tool 800. Once the setting force is applied and the setting tool 800 and the mandrels 605, 660, 695 are moving downward, the sleeve 931 will also move towards the shoulder 921 of the actuator 911. The sleeve 931 and the actuator 911 will abut and then compress the packing element 913-915 and cause the soft portion 914 to extend into contact with the casing (not shown). While this is happening, the shear screw 922 will break and the packer mandrel 918 will ratchet downward relative to the sleeve 920, thereby locking the packing element 913-915 in compression.

Once the upward releasing force is applied to the bypass mandrel 605 and the shoulder 637 abuts the packer mandrel 918, the releasing force will break the shear pin of the ratchet assembly 919. This will allow the packer mandrel 918 to move upward relative to the sleeve 920, thereby allowing the soft portion 914 of the packer element to disengage the casing. This relative movement will continue until the packer mandrel 918 abuts the gage case 917.

While the foregoing is directed to embodiments of the present invention, other and further embodiments of the invention may be devised without departing from the basic scope thereof, and the scope thereof is determined by the claims that follow.

The invention claimed is:

1. A latch assembly for coupling to a bottom hole assembly (BHA), comprising:

a tubular, wherein the latch assembly is disposable within the tubular and configured to be rotationally and axially coupled to the tubular;

one or more sleds disposed within one or more respective slots formed along at least a portion of a locking mandrel;

one or more retractable axial drag blocks configured to engage a matching axial profile disposed in the tubular, wherein each axial drag block is coupled to the respective sled with one or more biasing members; and the locking mandrel actuatable between a first position and a second position and preventing retraction of the axial drag blocks when actuated to the second position.

2. The latch assembly of claim 1, wherein the latch assembly is configured to be released from the tubular by applying a tensile force to the latch assembly.

3. The latch assembly of claim 1, comprising:

a drag block body having a bore therethrough; and one or more retractable torsional drag blocks configured to engage a matching torsional profile disposed in the tubular, wherein each torsional drag block is coupled to the drag block body with a biasing member.

4. The latch assembly of claim 1, comprising:

one or more cup rings sealingly engageable with the tubular.

5. The latch assembly of claim 4, further comprising:

one or more packer rings, wherein each cup ring is configured to expand each packer ring into sealing engagement with the tubular when an actuation pressure is exerted on each cup ring.

6. The latch assembly of claim 5, wherein each cup ring is configured to exert a compressive force on each packer ring to expand each packer ring.

7. The latch assembly of claim 1, comprising:

a body having a bore formed therethrough and having one or more ports formed through a wall thereof; and a mandrel having a bore therethrough and at least partially disposed within the body, wherein the mandrel is actuatable between a first position and a second position and the mandrel closes the ports when actuated to the second position.

8. The latch assembly of claim 7, further comprising:

a bypass mandrel having a bore formed therethrough;

a first collet having one or more retractable, cantilevered fingers and coupled to the bypass mandrel;

a collet mandrel having a bore formed therethrough and coupled to the bypass mandrel;

a cup mandrel disposed along the bypass mandrel and having a shoulder therein engagable with the first collet;

a case disposed along the bypass mandrel and coupled to the cup mandrel;

a second collet having one or more retractable, cantilevered fingers and coupled to the collet mandrel;

a collet retainer disposed between the cup mandrel and the case and engageable with the fingers of the second collet, wherein the fingers of the second collet and the collet retainer are configured so that the fingers of the second collet will disengage the collet retainer when a first force is applied to the bypass mandrel and engage the collet retainer when a second force is applied to the bypass mandrel, the first force being greater than the second force.

9. The latch assembly of claim 1, comprising:

a packing element sealingly engageable with the tubular, disposed along and coupled to a packer mandrel, and coupled to a packer compression member; and the packer compression member releasably coupled to the packer mandrel with a ratchet assembly, wherein the packing element will be held in sealing engagement with the tubular when actuated by a setting force and released from sealing engagement with the tubular when the packer compression member is released from the packer mandrel by a releasing force.

10. The latch assembly of claim 1, comprising:

a mandrel having a bore therethrough;

a setting tool releasably coupled to the mandrel, wherein the setting tool is configured to transfer a first force to the latch assembly applied to the setting tool by either a run in device or fluid pressure and to release the mandrel upon application of a second force to the setting tool by the run in device or fluid pressure.

11. The latch assembly of claim 10, wherein the setting tool comprises:

a bypass mandrel having a bore formed partially therethrough and having one or more ports formed through a wall thereof;

a center mandrel having a bore therethrough and having one or more ports formed through a wall thereof;

a housing coupled to the center mandrel and disposed along the bypass mandrel, wherein the bypass mandrel is actuatable between a first position and a second position and the bypass mandrel closes the center mandrel ports when actuated to the second position and the bypass mandrel ports are closed by the housing when the bypass mandrel is actuated to the second position.

12. The latch assembly of claim 10, wherein the setting tool comprises:

a cup ring sealingly engageable with the tubular;

a packer ring, wherein the cup ring is configured to expand the packer ring into sealing engagement with the tubular when an actuation pressure is exerted on the cup ring.

13. The latch assembly of claim 10, wherein the setting tool comprises:

a spear mandrel having a bore therethrough;

a collet having one or more retractable, cantilevered fingers and disposed along the spear mandrel; and a locking case disposed along the spear mandrel and coupled to the collet with a biasing member, wherein the collet is actuatable between a first position, where the fingers are prevented from retracting due to engagement with the spear mandrel, and a second position where the fingers are free to retract.

14. The latch assembly of claim 13 wherein the setting tool further comprises:

a center mandrel having a bore therethrough coupled to the spear mandrel;

a shear pin case coupled to the locking case and actuatable between a first position, where the shear pin case is coupled to the center mandrel by one or more shear pins and a second position, where the shear pin case is coupled to the center mandrel by a snap ring and the fingers are free to retract.

15. The latch assembly of claim 1, comprising:

means for axially and torsionally engaging the tubular.

16. The latch assembly of claim 15, further comprising:

means for transferring a setting force to the latch assembly and releasing the latch assembly when a releasing force is applied to the means.

17. A method of installing a latch assembly in a tubular, comprising:

running a latch assembly into the tubular using a run in device, wherein running the latch assembly into the tubular using the run in device comprises:

running the latch assembly and a setting tool into the tubular using the run in device until one or more axial drag blocks of the axial engagement member engage a matching axial profile in the tubular; and setting the latch assembly by setting an axial engagement member and a rotational engagement member thereby axially and rotationally coupling the latch assembly to the tubular wherein the axial engagement member is axially spaced from the rotational engagement member, wherein setting the latch assembly, thereby axially and rotationally coupling the latch assembly to the tubular, comprises rotating either the tubular relative to the latch assembly or the latch assembly relative to the tubular until one or more torsional drag blocks of the rotational engagement member engages a matching torsional profile in the tubular and exerting a first setting force on the setting tool using the run in device or by applying fluid pressure to the setting tool, wherein the setting tool will transfer the first setting force to the latch assembly and a locking mandrel will move axially relative to the axial drag blocks, thereby preventing the axial drag blocks from disengaging the axial profile.

18. The method of claim 17, further comprising:

exerting a second setting force on the setting tool using the run in device or by applying fluid pressure to the setting tool, wherein a releasable latch mechanism, coupling the setting tool to the latch assembly will disengage the latch assembly.

19. The method of claim 17, further comprising:

running a retrieval device into the tubular to the latch assembly using the run in device, wherein the retrieval device will engage the latch assembly; and wherein exerting a tensile force on the latch assembly, thereby un-setting the latch assembly from the tubular, comprises:

exerting a tensile force on the latch assembly using the run in device, wherein the locking mandrel will move axially relative to the axial drag blocks, the axial drag blocks will disengage the axial profile, and the torsional drag blocks will disengage the torsional profile.

20. The method of claim 17, further comprising:

pumping fluid through the tubular to verify that the latch assembly has set.

21. The method of claim 17, further comprising exerting a tensile force on the latch assembly, thereby releasing the latch assembly from the tubular.

22. A latch assembly for coupling a bottom hole assembly to a tubular, the latch assembly comprising:

one or more engagement members configured to rotationally and axially couple the latch assembly to the tubular;

a bypass mandrel having a bore formed thereth rough;

a first collet having one or more retractable, cantilevered fingers and coupled to the bypass mandrel;

a collet mandrel having a bore formed therethrough and coupled to the bypass mandrel;

a cup mandrel disposed along the bypass mandrel and having a shoulder therein engagable with the first collet;

a case disposed along the bypass mandrel and coupled to the cup mandrel;

a second collet having one or more retractable, cantilevered fingers and coupled to the collet mandrel; and a collet retainer disposed between the cup mandrel and the case and engageable with the fingers of the second collet, wherein the fingers of the second collet and the collet retainer are configured so that the fingers of the second collet will disengage the collet retainer when a first force is applied to the bypass mandrel and engage the collet retainer when a second force is applied to the bypass mandrel, the first force being greater than the second force.

23. The latch assembly of claim 22, further comprising a body having a bore formed therethrough and having one or more ports formed through a wall thereof; and a mandrel having a bore therethrough and at least partially disposed within the body, wherein the mandrel is actuatable between a first position and a second position and the mandrel closes the ports when actuated to the second position.

24. A latch assembly disposable within the tubular for coupling a bottom hole assembly (BHA) to a tubular, comprising:

a retrieval member disposable within the tubular;

a first engagement member for engaging the tubular;

a second engagement member for engaging the tubular, wherein the second engagement member is axially spaced from the first engagement member, and wherein the first engagement member and the second engagement member are configured to rotationally and axially couple the latch assembly and the bottom hole assembly to the tubular;

two or more ports, including upper and lower ports, to facilitate axial movement of the latch assembly in the tubular; and a bypass mandrel adapted to open and close the upper port and the lower port.

25. The latch assembly of claim 24, wherein the first engagement member further comprises:

one or more retractable axial drag blocks configured to engage a matching axial profile disposed in the tubular; and one or more biasing members configured to bias the one or more retractable axial drag blocks into engagement with the tubular.

26. The latch assembly of claim 25, further comprising a locking mandrel actuatable between a first position and a second position and preventing retraction of the axial drag blocks when actuated to the second position.

27. The latch assembly of claim 26, further comprising one or more sleds disposed within one or more respective slots formed along at least a portion of the locking mandrel, and wherein the one or more biasing members are coupled to one or more sleds.

28. The latch assembly of claim 24, wherein the second engagement member further comprises:

a drag block body having a bore therethrough; and one or more retractable torsional drag blocks configured to engage a matching torsional profile disposed in the tubular, wherein each torsional drag block is coupled to the drag block body with a biasing member.

29. A method of installing a latch assembly in a tubular, comprising:

running a latch assembly into the tubular using a run in device;

setting the latch assembly by setting an axial engagement member and a rotational engagement member thereby axially and rotationally coupling the latch assembly to the tubular wherein the axial engagement member is axially spaced from the rotational engagement member;

providing one or more sleds disposed within one or more slots formed along at least a portion of a locking mandrel;

engaging one or more axial profiles disposed in the tubular with one or more axial drag blocks which is coupled to the one or more sleds with one or more biasing members;

actuating the locking mandrel to a locking position; and preventing retraction of the one or more axial drag blocks when the locking mandrel is in the locking position.

* * * * *

UNITED STATES PATENT AND TRADEMARK OFFICE

CERTIFICATE OF CORRECTION

PATENT NO. : 7,360,594 B2
APPLICATION NO. : 10/795214
DATED : April 22, 2008
INVENTOR(S) : Giroux et al.

It is certified that error appears in the above-identified patent and that said Letters Patent is hereby corrected as shown below:

On the Title Page:

Item (75) Inventors, please delete "Albert C. Odell, III" and insert --Albert C. Odell, II--;

Item (57) Abstract, Line 8, please delete "the latch" after "The latch";

Please delete "6,453,257 B1 8/2002 Juhasz et al.";

In the Claims:

Column 23, Claim 22, Line 25, please delete "thereth rough" and insert --therethrough--.

Signed and Sealed this

Eighteenth Day of November, 2008

JON W. DUDAS
*Director of the United States Patent and Trademark Office*